US011459772B2

(12) United States Patent
Schultz et al.

(10) Patent No.: US 11,459,772 B2
(45) Date of Patent: Oct. 4, 2022

(54) SIDING PANEL WITH A RECESSED LOCKING SECTION

(71) Applicant: CERTAINTEED CORPORATION, Malvern, PA (US)

(72) Inventors: Ashley A. Schultz, Jackson, MI (US); Christopher Michael Colyn, Jackson, MI (US); David J. Stucky, Grass Lake, MI (US); Robert D. Shaw, Parma, MI (US); Greg Holland, Jackson, MI (US)

(73) Assignee: CERTAINTEED LLC, Malvern, PA (US)

( * ) Notice: Subject to any disclaimer, the term of this patent is extended or adjusted under 35 U.S.C. 154(b) by 0 days.

(21) Appl. No.: 16/730,167

(22) Filed: Dec. 30, 2019

(65) Prior Publication Data

US 2020/0131781 A1 Apr. 30, 2020

Related U.S. Application Data

(63) Continuation of application No. 15/856,893, filed on Dec. 28, 2017, now Pat. No. 10,544,593.

(60) Provisional application No. 62/462,131, filed on Feb. 22, 2017, provisional application No. 62/440,844, filed on Dec. 30, 2016.

(51) Int. Cl.
*E04F 13/08* (2006.01)
*E04F 21/18* (2006.01)

(52) U.S. Cl.
CPC ..... *E04F 13/0876* (2013.01); *E04F 13/0864* (2013.01); *E04F 21/1855* (2013.01); *E04F 13/0851* (2013.01)

(58) Field of Classification Search
CPC ..... E04F 13/0864; E04F 13/0876; E04F 13/0894; E04F 21/1855; E04F 13/0851; E04D 3/362
See application file for complete search history.

(56) References Cited

U.S. PATENT DOCUMENTS

| | | | |
|---|---|---|---|
| 2,258,247 | A | 10/1941 | Hull |
| 4,043,088 | A | 8/1977 | Payton |
| 4,122,643 | A | 10/1978 | Hafner |
| 4,292,781 | A | 10/1981 | Chalmers et al. |
| 4,308,702 | A | 1/1982 | Rajewski |
| 4,435,933 | A | 3/1984 | Krowl |
| 5,022,207 | A | 6/1991 | Hartnett |
| 5,129,204 | A | 7/1992 | Palumbo |
| 5,388,381 | A | 2/1995 | Bilinski et al. |
| 5,475,963 | A | 12/1995 | Chelednik |
| 5,651,227 | A | 7/1997 | Anderson |
| 5,661,939 | A | 9/1997 | Coulis et al. |
| 5,768,844 | A | 6/1998 | Grace, Sr. et al. |
| 5,878,543 | A | 3/1999 | Mowery |
| 5,887,403 | A | 3/1999 | Beck |
| 5,946,876 | A | 9/1999 | Grace, Sr. et al. |
| 6,026,624 | A | 2/2000 | Patel et al. |
| 6,065,260 | A | 5/2000 | Dickey et al. |

(Continued)

*Primary Examiner* — Brian E Glessner
*Assistant Examiner* — Daniel J Kenny
(74) *Attorney, Agent, or Firm* — Abel Schillinger, LLP; Thomas H. Osborn

(57) ABSTRACT

A siding panel includes a hanger section adjacent to an upper edge and a lower locking section adjacent to a lower edge. When installed, the lower locking section of an upper siding panel partially overlaps, extends into, and interlocks with a hanger section of a lower siding panel in an interference fit.

15 Claims, 33 Drawing Sheets

(56) References Cited

U.S. PATENT DOCUMENTS

| | | | | |
|---|---|---|---|---|
| 6,363,676 | B1 * | 4/2002 | Martion, III | E04F 13/0864 52/519 |
| 6,370,832 | B1 | 4/2002 | McGarry et al. | |
| 6,408,580 | B1 | 6/2002 | Jurvis et al. | |
| 6,516,577 | B2 | 2/2003 | Pelfrey et al. | |
| 6,526,718 | B2 | 3/2003 | Manning et al. | |
| 7,040,067 | B2 | 5/2006 | Mowery et al. | |
| 7,562,505 | B2 | 7/2009 | Tohanczyn, Jr. | |
| 7,685,787 | B1 | 3/2010 | Mollinger et al. | |
| 7,698,865 | B2 | 4/2010 | Pringle et al. | |
| 7,739,847 | B2 | 6/2010 | Griman | |
| 7,775,008 | B2 | 8/2010 | King | |
| 7,775,009 | B2 | 8/2010 | King | |
| 7,779,594 | B2 | 8/2010 | Mowery et al. | |
| 8,136,323 | B2 | 3/2012 | King | |
| 8,245,476 | B2 | 8/2012 | Sergounine | |
| 8,387,325 | B2 | 3/2013 | Mullet et al. | |
| 8,590,249 | B1 | 11/2013 | Loper et al. | |
| 8,800,231 | B2 * | 8/2014 | Wagner | E04F 13/0801 52/537 |
| 8,864,361 | B2 | 10/2014 | Wagner et al. | |
| 8,915,036 | B2 | 12/2014 | Vander Laan et al. | |
| 9,523,202 | B2 | 12/2016 | Anderson et al. | |
| D818,151 | S | 5/2018 | Sexton et al. | |

* cited by examiner

SIDING PANEL WITH A RECESSED LOCKING SECTION

CROSS-REFERENCE TO RELATED APPLICATION(S)

The present application is a continuation of and claims priority to U.S. patent application Ser. No. 15/856,893, filed on Dec. 28, 2017, by Ashley A. SCHULTZ et al. and entitled "SIDING PANEL WITH A RECESSED LOCKING SECTION," which claims priority under 35 U.S.C. § 119(e) to U.S. Provisional Patent Application No. 62/440,844, filed on Dec. 30, 2016, by Ashley A. SCHULTZ et al. and entitled "LOW PROFILE SIDING PANEL WITH RECESSED LOCK AREA," and claims priority under 35 U.S.C. § 119(e) to U.S. Provisional Patent Application No. 62/462,131, filed on Feb. 22, 2017, by Ashley A. SCHULTZ et al. and entitled "SIDING PANEL WITH A RECESSED LOCKING SECTION," which applications are assigned to the current assignee hereof and incorporated by reference herein in their entireties.

BACKGROUND OF THE INVENTION

Field of the Disclosure

The present invention relates, in general, to exterior house siding panels and to exterior house siding panels that interlock.

Description of the Related Art

Buildings, such as houses, require exterior protection to guard against damage caused by the elements. Siding can be used to provide this protection. The different types of siding can include plastic siding, metal siding, fiber cement siding, or wood siding. Typically, siding is installed from bottom to top on a wall. A first course can be installed using one or more fasteners and then, a second course may be installed above the first course so that it partially overlaps the first course and covers the fasteners that are used to hold the first course in place. The process of overlapping the next highest course of siding can be repeated until the top of the wall is reached. It can be appreciated that each type of siding has its advantages and drawbacks.

Accordingly, the construction industry continues to demand improved construction materials, particularly for exterior siding for houses.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is generally directed to house siding panels that are suitable for providing exterior protection from weather elements for houses and other buildings. Individual house siding panels can be affixed to the exterior walls of a dwelling or other structure and can be interlocked and overlapped to provide a sufficient barrier to protect the dwelling from the elements, such as rain, sleet, or snow.

Embodiments are directed to house siding panels that include a hanger section that includes a recessed locking section and a lower locking section. When adjacent siding panels are installed on a structure, an upper siding panel can interlock with a lower siding panel. Specifically, a lower locking section on an upper siding panel can overlap and engage a hanger section on a lower siding panel and the lower locking section can extend into and engage the recessed locking section of the lower siding panel.

Siding Panel

Figure 1:
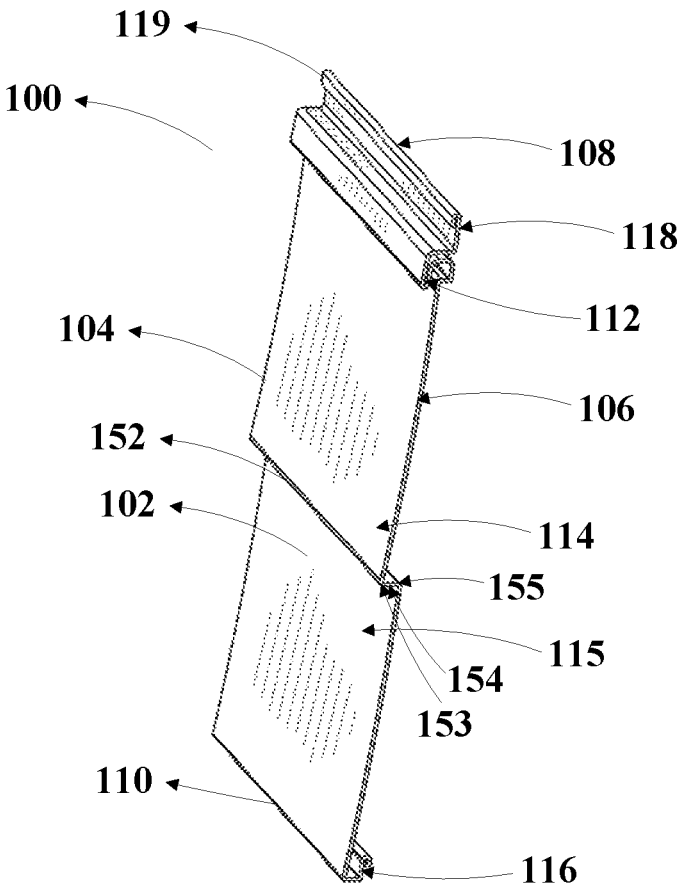
FIG. 1 is a perspective view of an embodiment of a house siding panel.
Figure 2:
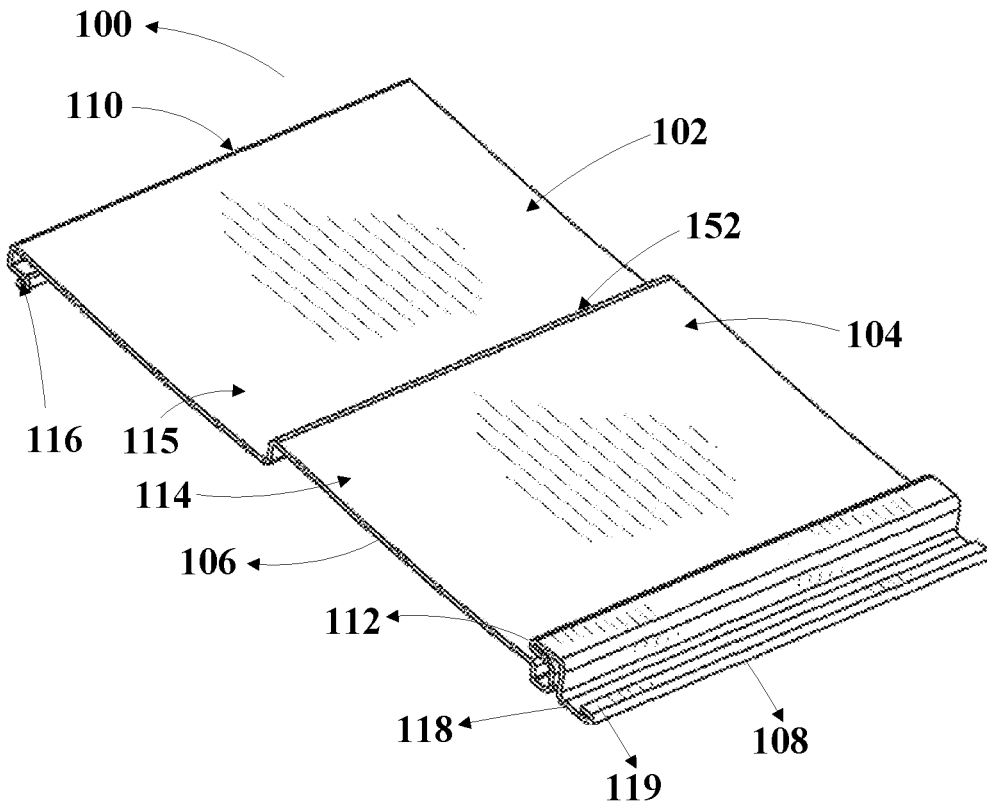
FIG. 2 is another perspective view of an embodiment of a siding panel.

FIGS. 1 and 2 provide perspective views of an embodiment of a siding panel 100. In an embodiment, siding panel 100 may be configured to be affixed to a vertical wall of a structure, such as a house. In an embodiment, siding panel 100 may be configured to affix to another siding panel. In an embodiment, the siding panel 100 may include a siding body 102 including at least one stretch. As illustrated in FIGS. 1 and 2, siding body 102 may include a stretch 114 and a stretch 115. In an embodiment, at least one ridge 152 may extend laterally across at least a portion of a width, or across the entire width, of the siding body 102. The ridge 152 can extend between and connect stretch 114 and stretch 115. In a particular embodiment, stretch 115 may be staggered below stretch 114 by the ridge 152. Ridge 152 can include an edge 153, an opposite edge 155, and a shelf 154 extending from edge 153 to edge 155. When a panel 100 is positioned on a wall, shelf 154 may extend inwardly towards the wall from edge 153 adjacent stretch 114 to edge 155 adjacent stretch 115, or vice versa.

In an embodiment, the length of siding body 102 may be delimited by edge 108 on one end and edge 110 on an opposite end. In an embodiment, edge 108 may include a fastener zone 118 that may extend along the entirety of edge 108. Fastener zone 118 may define at least one fastener slot (not depicted) extending through the thickness of fastener zone 118. In an embodiment, fastener zone 118 may be adapted to receive an attachment device, i.e., a fastener. The attachment device may include, but is not limited to, a nail, a screw, and the like. The attachment device may extend through the attachment orifice to affix panel 100 to a wall of a structure. In an embodiment, fastener zone 118 may include a folded portion 119, which may be folded on itself, to provide additional reinforcement when the fastener zone 118 is affixed to a wall.

In an embodiment, siding panel 100 may be shaped to assume the longitudinal profile, the cross-sectional profile, or both the longitudinal and cross-sectional profiles of an exterior siding design. The exterior siding design may include, for example, the design illustrated in FIGS. 1 and 2. In a particular embodiment, siding panel 100 may be constructed as a unitary, elongated siding body 102 having a surface 104 and an opposite surface 106. Surface 104 may be a front surface formed to convey any desired protective, aesthetic, or decorative effect. In an embodiment, surface 104 may assume a smooth appearance, a textured appearance, or a combination of smooth and textured appearances. The textured appearance can include, without limitation, simulated wood grain (not illustrated). Siding body 102, or at least surface 104 of siding body 102, may include a pigment for coloration. In an embodiment, siding body 102, or at least surface 104 of siding body 102, may be subjected to further molding, calendaring, finishing, or other machining to provide a simulated wood grain or other texture. Surface 106 can be a rear surface such that, when panel 100 is affixed to a wall, surface 106 may be adjacent the wall of a structure. In general, siding panel 100 may be formed to resemble a single board, slat, or similar elongated siding member. Siding panel 100 may include a retaining loop 112 adjacent edge 108 and an engagement portion 116 adjacent edge 110.

Siding Panel Assembly

Figure 3:
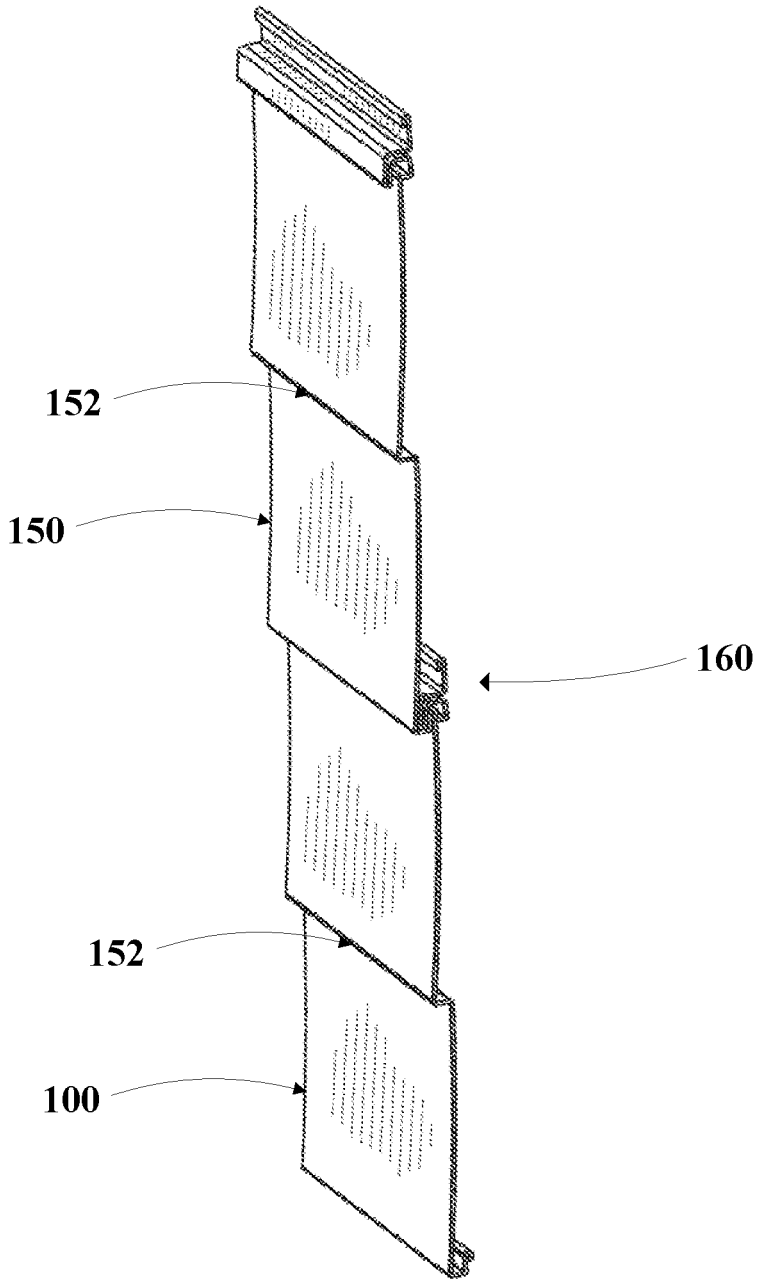
FIG. 3 is a side view of an embodiment of a first siding panel affixed to a second siding panel.
Figure 4:
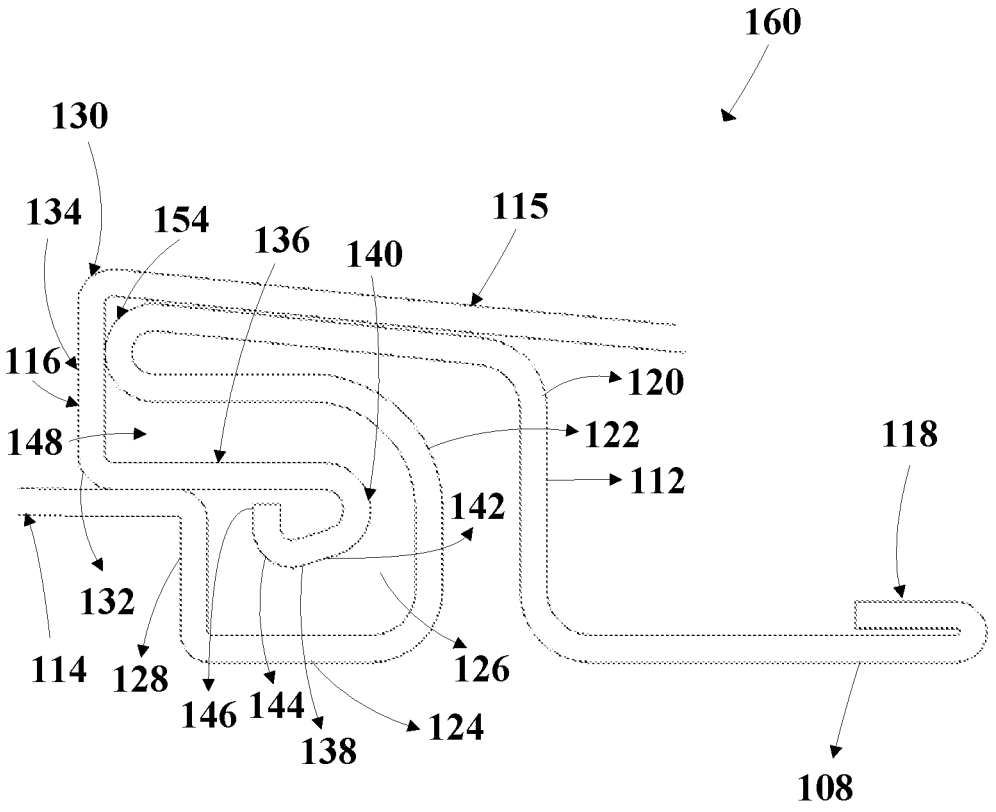
FIG. 4 is an enlarged view of the interlocking portions of the siding panels of FIG. 3.
Figure 5:
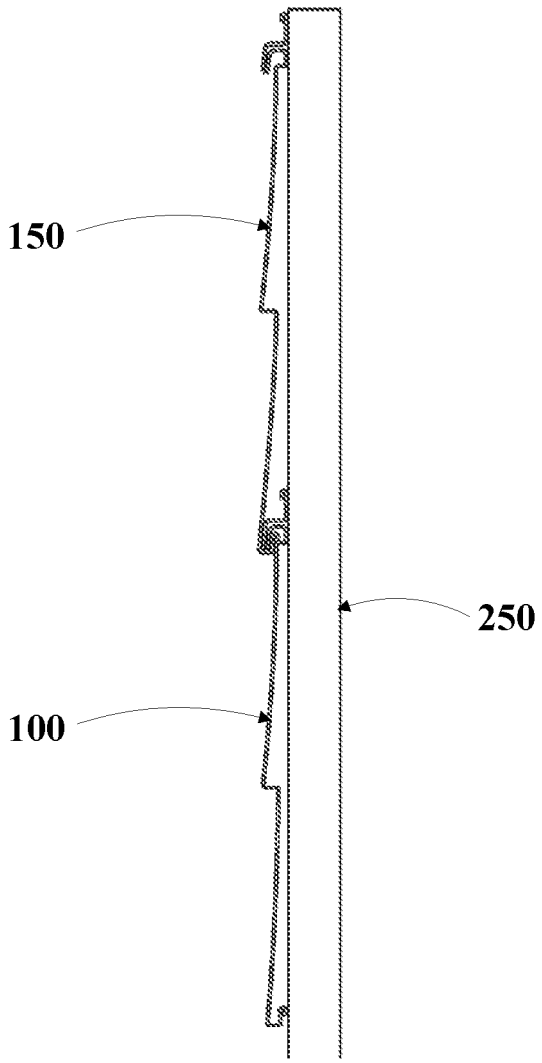
FIG. 5 is a side view of an embodiment of a plurality of siding panels affixed to a wall.

As illustrated in FIGS. 3 to 5, retaining loop 112 of a first siding panel 100 may be configured to receive engagement portion 116 of a second siding panel 150. FIG. 4 is an enlarged view of the interlock portions 160 of the siding panels 100 and 150 of FIG. 3. FIG. 5 illustrates first siding panel 100 and second siding panel 150 affixed to one another and to a wall 250.

As illustrated in FIG. 4, retaining loop 112 may project outward from the siding body 102 in order to provide space to receive the engagement portion 116. Retaining loop 112 may include an outer curve 120 and an inner curve 122. A space may be defined between outer curve 120 and inner curve 122. Inner curve 122 may terminate at a flat base 124. Inner curve 122 and flat base 124 may define a recess 126 within the retaining loop 112 and flat base 124 may define a base of the recess 126. The recess 126 of siding panel 100 may receive the engagement portion 116 of another siding panel, such as siding panel 150, when affixed to one another. In an embodiment, the flat base 124 may be aligned with the edge 108. For example, flat base 124 may lie along the same plane as edge 108.

A retaining wall 128 may extend outward from the end of the flat base 124, and toward retaining loop 112. In an embodiment, retaining wall 128 may terminate at stretch 114, which may extend all the way to engagement portion 116, or to ridge 152, at an outward angle in relation to flat base 124. A gap 148 may be defined adjacent to the retaining wall 128 and along stretch 114. In an embodiment, the gap 148 may be adapted to receive an engagement portion 116 of another siding panel, such as siding panel 150. In an embodiment, stretch 114 may be substantially parallel to at least a portion of the outer curve 120 when the siding panel 100 is engaged with a second siding panel 150.

In an embodiment, retaining loop 112 of siding panel 100 may include a hairpin bend 154 at the converging point of the outer curve 120 and the inner curve 122. The gap 148 may be established between the hairpin bend 154 and stretch 114 adjacent to the retaining wall 128. The hairpin bend 154 may extend toward the edge 110 and configured so that space is created (recess 126) to receive engagement portion 116 of another siding panel, such as siding panel 150. Retaining wall 128 may be positioned closer to the edge 108 than the end of the hairpin bend 154 in order to provide additional security for the engagement portion 116 of another siding panel, such as siding panel 150, when the engagement portion 116 of another siding panel, such as siding panel 150, is engaged with retaining loop 112 of siding panel 100. In certain embodiments, the outer curve 120 may project at an outward angle in relation to the flat base 124.

Engagement portion 116 may comprise a first outer bend 130, a second outer bend 132, a first extension 134, a second extension 136, and an ending loop 138. Stretch 115 may terminate at first outer bend 130 located at bottom edge 110. The first extension 134 may extend inwardly toward and may terminate at the second outer bend 132. In an embodiment, the first extension 134 may be parallel, or substantially parallel, to the retaining wall 128. In another aspect, the first extension 134 may be slightly angled with respect to the retaining wall 128. For example, this angle may be less than or equal to 5°. Further, this angle may be less than or equal to 4.5°, such as less than or equal to 4°, less than or equal to 3.5°, less than or equal to 3.0°, less than or equal to 2.5°, less than or equal to 2.0°, less than or equal to 1.5°, less than or equal to 1.0°, less than or equal to 0.75°, less than or equal to 0.5°, or less than or equal to 0.25°.

As illustrated in FIG. 2, when first and second siding panels 100,150 are engaged, the first outer bend 130 of the second siding panel 150 may engage the retaining loop 112 of first siding panel 100 so that an upward force may be applied to the retaining loop 112 by the first outer bend 130 when the second panel is affixed to a wall 250 (see FIG. 5). This force may increase the efficiency of the interlocking relationship between first and second panels 100,150.

The second extension 136 extending from the second outer bend 132 may project toward the edge 108 of the siding panel 100. The second extension 136 may terminate at the ending loop 138. In an embodiment, the ending loop 138 may include a leading bend 140, a cantilever leg 142, a lower bend 144, and a tip 146. The cantilever leg 142 may be positioned between the leading bend 140 and the lower bend 144. The tip 146 may be positioned outward in relation to the siding body 102 at an end of the lower bend 144 opposite the cantilever leg 142 and perpendicular, or substantially perpendicular, to the second extension 136.

Engagement of the first siding panel 100 and second siding panel 150 may be carried out via the engagement of the engagement portion 116 of the second siding panel 150 with the retaining loop 112 of the first siding panel 100. To insert the engagement portion 116 into the retaining loop 112, the engagement portion 116 may be positioned below the retaining loop 112 so that the lower bend 144 contacts stretch 114. An upward force (applied toward the top edge 108 of the panel 100) is then applied to first siding panel 100 (positioned below the second siding panel 150) so that the first extension 134 of the second siding panel 150 and the hairpin bend 154 of the first siding panel 100 contact one another. As the upward force is applied, or even continuously applied, an inward force is applied to the ending loop 138 and second extension 136 via the retaining loop 112 as the ending loop 138 is pulled closer to recess 126. The retaining loop 112 may flex to allow the engagement portion 116 to snap into and engage the retaining loop 112.

Second extension 136 and stretch 114 may contact one another once ending loop 138 is fully engulfed within recess 126. In certain embodiments, ending loop 138 may avoid contact with a perimeter portion of recess 126, such as inner curve 122, flat base 124, retaining wall 128, any combination thereof, or avoid any contact with all portions of recess 126. The ending loop 138 may avoid contact with a perimeter portion of recess 126 due to the contact between the first extension 134 and the hairpin bend 154. It is noted that additional security between the engagement portion 116 and the retaining loop 112 may be provided due to the positioning of retaining wall 128. If it was attempted to force the ending loop 138 out of recess 126 and back through gap 148, retaining wall 128 may retain or "catch" ending loop 138, preventing outward movement of the ending loop 138 through gap 148.

Figure 6:
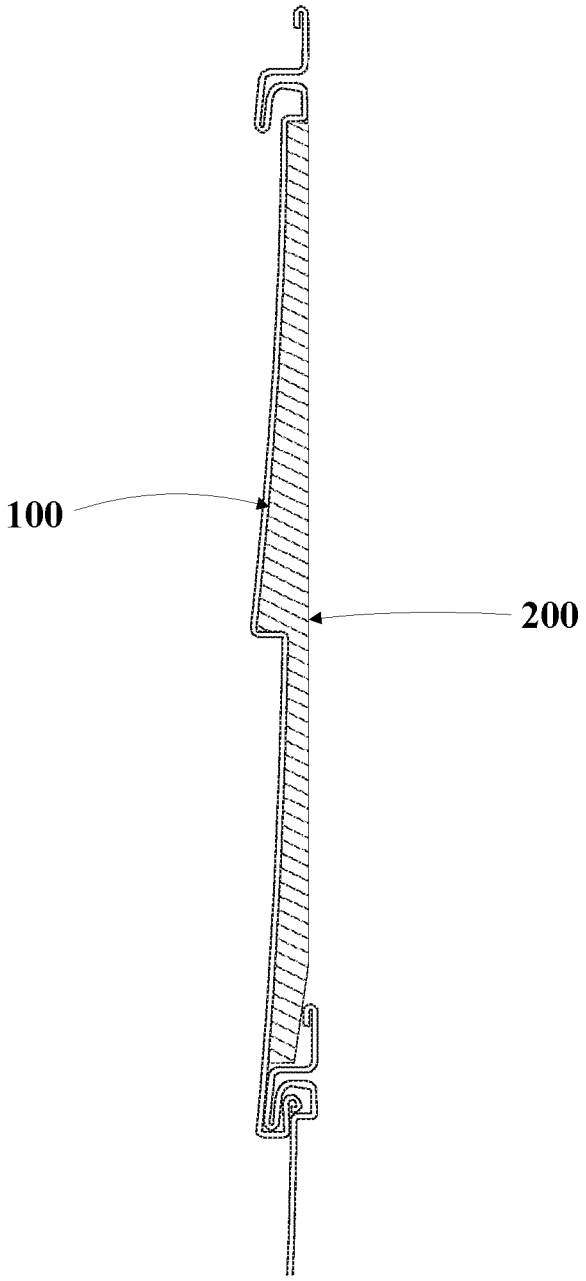
FIG. 6 is a side view of an embodiment of a siding panel with a foam backing.

In an embodiment, the siding panel 100 may include an optional foam backing layer 200, as illustrated in FIG. 6. The backing layer 200 may function as a spacer to hold the bottom of the siding panel 100 away from a wall to which the siding panel 100 is mounted. In an embodiment, the foam backing layer 200 may act as reinforcement to assist siding panel 100 in maintaining its general shape, such as in the event that the surface of the wall is irregular, the siding panel 100 is impacted by an external force, and the like. In an embodiment, the foam backing layer 200 may be affixed to surface 106 of the siding panel 100 via an adhesive.

The process for fabricating siding panel 100 may include a variety of conventional manufacturing techniques for thermoplastic and thermosetting materials.

In an embodiment, a mixture of pellets containing appropriate additives, as set forth below, may be heated, extruded through a die, and then, further shaped or formed, to produce panels 100 having lengths of a standard length. In certain embodiments, panel 100 may comprise a specific length, width, and thickness.

In an embodiment, a material for fabricating siding body 102 may include a resinous or polymeric material. For example, the material can include a thermoplastic resin, a thermosetting resin, or both. In an embodiment, the material can include a polyvinyl chloride (PVC), a polyethylene, a polypropylene, a nylon, a polyester, a polysulfone, a polyphenylene oxide, a sulfide, an epoxy, a cellulosic, or a composite material including any combination thereof. In an embodiment, the siding body 102 may comprise a metal.

In a particular embodiment, the material may include PVC, a copolymer including PVC, an alloy including PVC, or any combination thereof. A vinyl chloride monomer may be made from a process including the reaction of acetylene and hydrogen chloride and the direct chlorination of ethylene. PVC may be manufactured by the free radical polymerization of a vinyl chloride monomer. After polymerization, PVC may be combined with an additive. The additive may include, for example, an impact modifier, a thermal stabilizer, a lubricant, a plasticizer, an organic pigment, an inorganic pigment, a filler, a biocide, a processing aid, a flame retardant, or any combination thereof.

In an embodiment, vinyl chloride may be combined with another vinyl monomer in the manufacture of a PVC copolymer. The copolymer can be a linear copolymer, a graft copolymer, a random copolymer, a regular repeating copolymer, a block copolymer, and the like. The monomer combined with vinyl chloride to form a PVC copolymer may include an acrylonitrile, an alpha-olefin such as ethylene, propylene, and the like, a chlorinated monomer such as vinylidene dichloride, an acrylate monomer such as acrylic acid, methylacrylate, methyl-methacrylate, acrylamide, hydroxethyl acrylate, and others, a styrenic monomer such as styrene, alpha methyl styrene, vinyl toluene, and the like, a vinyl acetate, or other commonly available ethylenically unsaturated monomer compositions. In an embodiment, the monomer can be used in an amount of up to about 50 mol-%, or up to about 45 mol- %, or up to about 40 mol- %, the balance being vinyl chloride. In an embodiment, PVC can be compounded to be flexible or rigid, tough or strong, to have high or low density, or to have any of a wide spectrum of physical properties or processing characteristics. Further, a PVC resin can be alloyed with another polymer, such as an acrylonitrile butadiene styrene polymer ("ABS"), an acrylic polymer, a polyurethane, a nitrile rubber, or any combination thereof. In an embodiment, a PVC alloy can improve impact resistance, tear strength, resilience, or processability of the siding body 102. In an embodiment, the siding body 102 can be produced water-white in either rigid or flexible compositions. In an embodiment, the siding body 102 can be pigmented to almost any color.

Siding Panel

Figure 7:
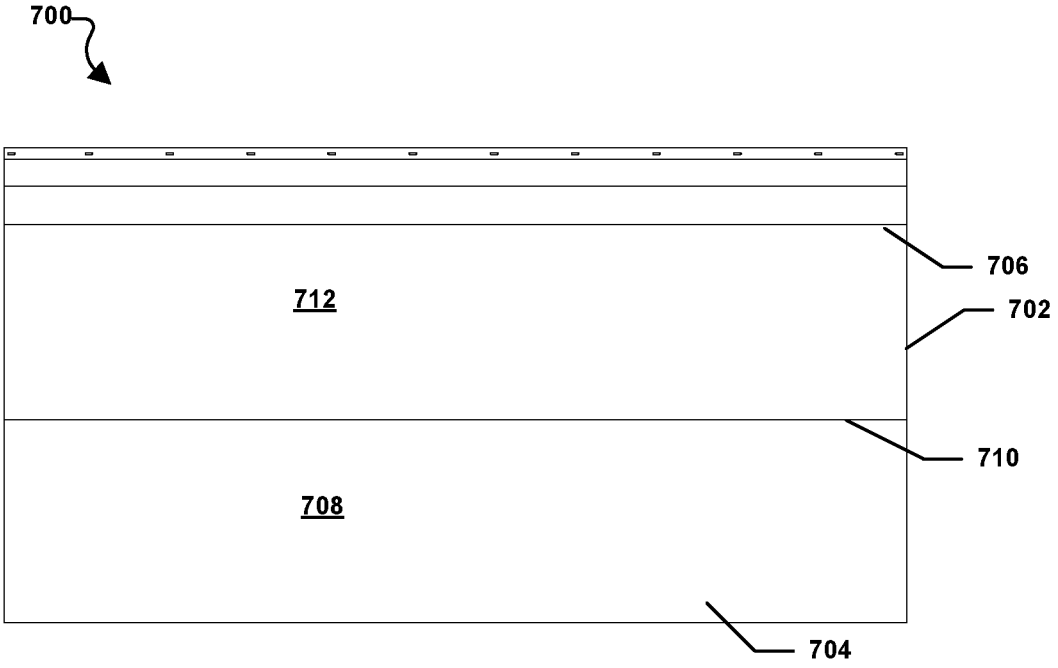
FIG. 7 includes an illustration of a front plan view of a house siding panel in accordance with an embodiment.

Referring now to FIG. 7, a siding panel is illustrated and is generally designated 700. FIG. 7 illustrates a front plan view of the siding panel 700 and as shown, the siding panel 700 can include a siding body 702 that can extend between a lower edge 704 and an upper edge 706. The siding panel 700 can include a lower extension portion 708 that can extend from the lower edge 704 of the siding body 702 to a central return leg 710. Further, the siding panel 700 can include an upper extension portion 712 that can extend from the central return leg 710 to the upper edge 706 of the siding body 702. When the siding panel 700 is installed on a structure, the lower extension portion 708 and the upper extension portion 712 are configured to visually simulate single courses of overlapping wood siding where the overlap is simulated by the central return leg 710. The central return leg 710 may also act as a ridge that can extend laterally across a width of the siding body 702.

Figure 8:
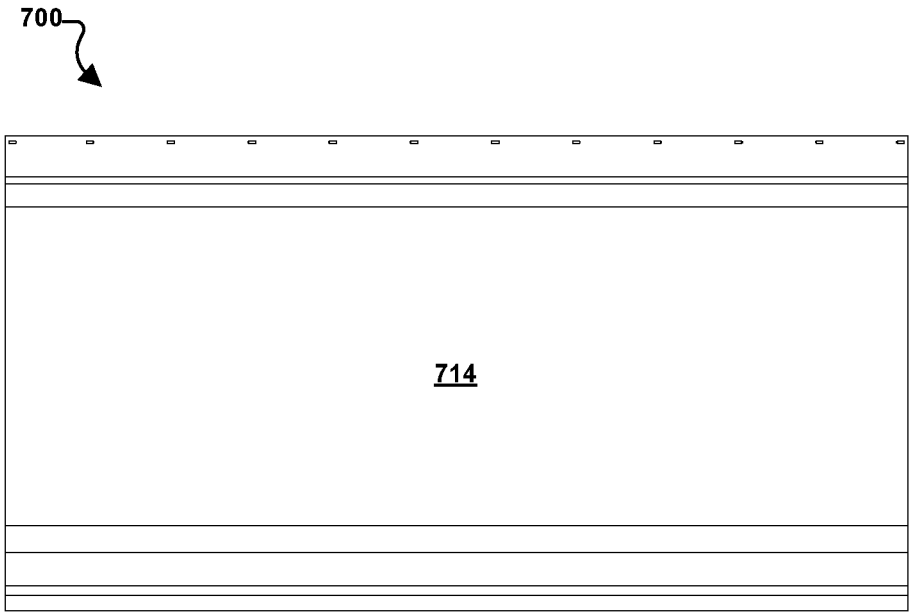
FIG. 8 includes an illustration of a rear plan view of a house siding panel in accordance with an embodiment.

FIG. 8 illustrates a rear plan view of the siding panel 700 and as illustrated, the siding panel 700 can further include a reinforcement panel 714 affixed to, or otherwise disposed on, a rear surface of the siding panel 700. In a particular aspect, the reinforcement panel 714 can be affixed to the rear surface of the siding body 702 of the siding panel 700 using an adhesive material. The reinforcement panel 714 can extend along a majority of a height of the siding body 702 of the siding panel 700, i.e., a height measured between the lower edge 704 of the siding panel 700 and the upper edge 706 of the siding body 702.

Figure 9:
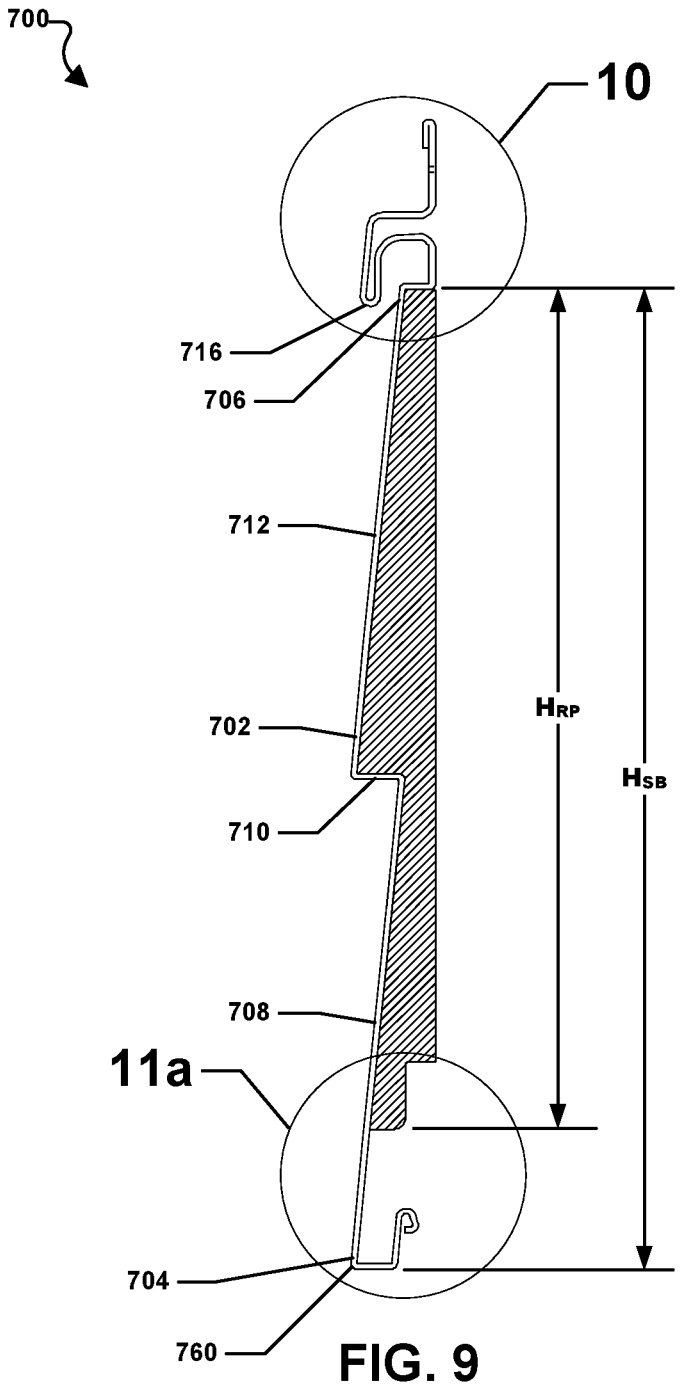
FIG. 9 includes an illustration of a side plan view of a house siding panel in accordance with an embodiment.

Specifically, as indicated in FIG. 9, the reinforcement panel 714 can extend along the entirety of the back side of the upper extension portion 712. Further, the reinforcement panel 714 can extend along a majority of the lower extension portion 708. In particular, the reinforcement panel 714 can include a height, $H_{RP}$. $H_{RP}$ can be measured from the upper edge of the reinforcement panel 714 to the lower end of the reinforcement panel. The siding body 702 of the siding panel 700 may also include a height, $H_{SB}$. $H_{SB}$ can be measured from the upper edge 706 of the siding body 702 to the lower edge 704 of the siding body 702.

As indicated in FIG. 9, $H_{RP}$ may be less than $H_{SB}$. For example, $H_{RP}$ may be less than 95% $H_{SB}$. Further, $H_{RP}$ may be less than 94% $H_{SB}$, such as less than 94% $H_{SB}$, less than 93% $H_{SB}$, less than 92% $H_{SB}$, less than 91% $H_{SB}$, or less than 90% $H_{SB}$. In another aspect, $H_{RP}$ may be at least 80% $H_{SB}$, such as at least 81% $H_{SB}$, at least 82% $H_{SB}$, at least 83% $H_{SB}$, at least 84% $H_{SB}$, or at least 85% $H_{SB}$. It is to be understood that $H_{RP}$ may be within a range between, and including, any of the maximum or minimum values of H disclosed herein.

Figure 10:
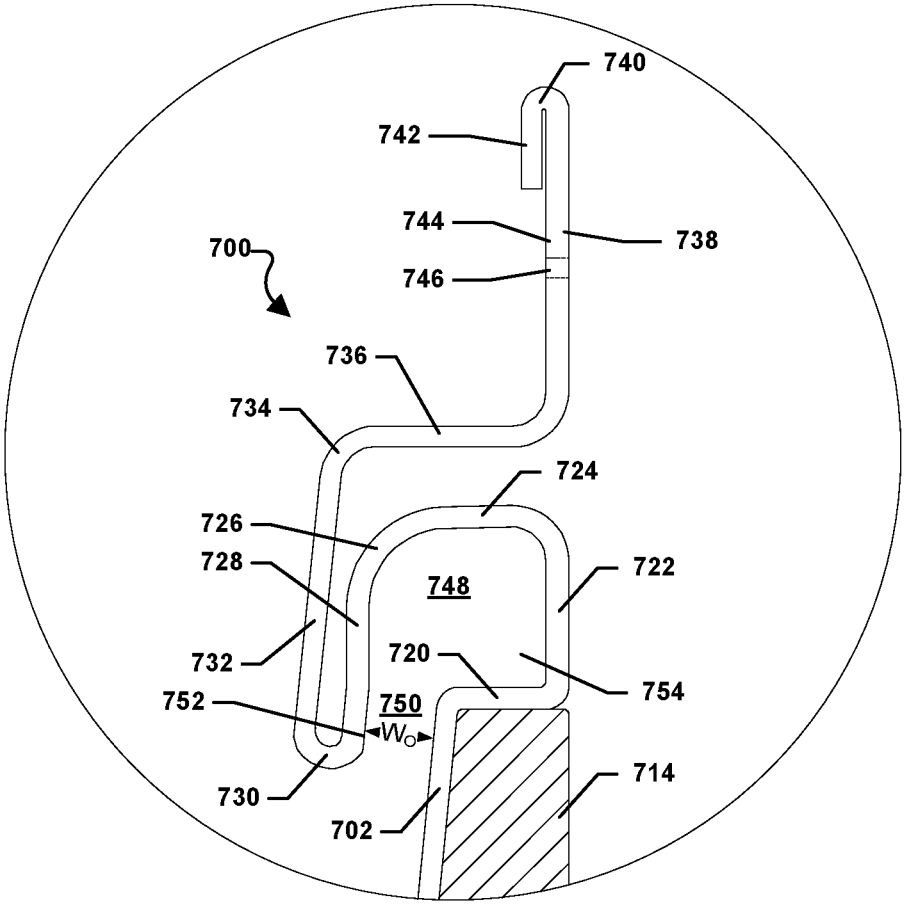
FIG. 10 includes an illustration of a detail view of a siding panel in accordance with an embodiment taken at Circle 10 in FIG. 9.
Figure 11A:
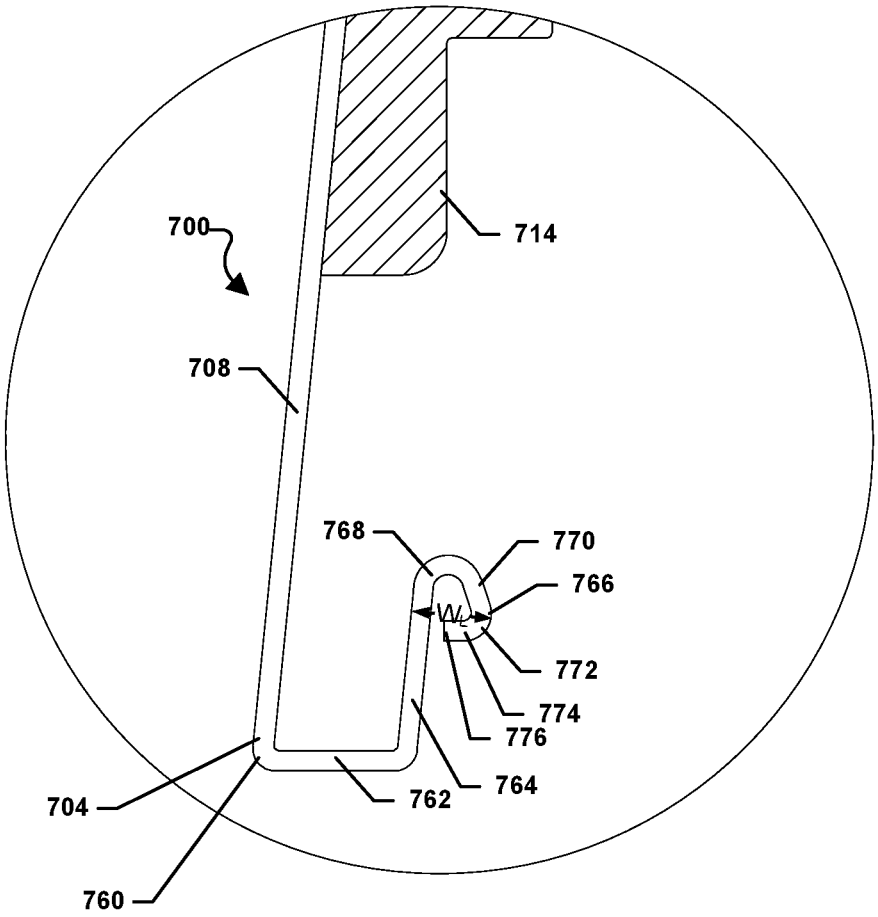
FIG. 11*a* includes an illustration of a detail view of a siding panel in accordance with an embodiment taken at Circle 11*a* in FIG. 9.

Referring now to FIG. 9 through FIG. 11*a*, greater detail concerning the construction, or configuration, of the siding panel 700 is illustrated. FIG. 9 illustrates a side plan view of the siding panel 700 while FIG. 10 and FIG. 11*a* illustrate detailed views of the siding panel 700 near the upper edge 706 and the lower edge 704, respectively. In particular, FIG. 9 and FIG. 10 indicate that the siding panel 700 can include a hanger section 716 that can extend outwardly and upwardly from the upper edge 706 of the siding body 702. It is to be understood the outward direction is the direction away from the wall on which the siding panel 700 may be installed. Further, the siding panel 700 may be installed so that the reinforcement panel 714 is immediately adjacent to, or closest to, a wall of the building or structure on which the siding panel 700 is installed.

Specifically, the hanger section 716 can include a lower lateral wall 720 that can extend inwardly from the upper edge 706 of the siding body 702. The lower lateral wall 720 can be substantially parallel to the central return leg 710. In another aspect, central return leg 710 can be slightly angled with respect to the lower lateral wall 720. For example, this angle may be less than or equal to 5°. Further, this angle may be less than or equal to 4.5°, such as less than or equal to 4°, less than or equal to 3.5°, less than or equal to 3.0°, less than or equal to 2.5°, less than or equal to 2.0°, less than or equal to 1.5°, less than or equal to 1.0°, less than or equal to 0.75°, less than or equal to 0.5°, or less than or equal to 0.25°. The lower lateral wall 720 of the hanger section 716 of the siding body 702 can act as a guide or alignment feature for disposition of the reinforcement panel 714 on the rear surface of the siding panel 700.

A lower inner wall 722 can extend in an upward direction from the lower lateral wall 720. In a particular aspect, the lower inner wall 722 can be substantially perpendicular to the lower lateral wall 720. Further, as illustrated, an upper return leg 724 can extend outwardly from the lower inner wall 722. In particular, the upper return leg 724 can be perpendicular to the lower inner wall 722. Moreover, the upper return leg 724 may be parallel to the lower lateral wall 720. An inner curve 726 can extend from the upper return leg 724 and can curve in a downward direction, i.e., toward the lower edge 704 of the siding body 702. In addition, the inner curve 726 can connect to an intermediate outer wall 728. The intermediate outer wall 728 can extend in a generally downward direction.

As further shown in FIG. 10, a lower converging bend 730 can extend from the intermediate outer wall 728 and can turn nearly 180 degrees and an outer wall 732 can extend in an upward direction from the lower converging bend 730. An outer curve 734 can connect an upper lateral extension 736 to the outer wall 732. The upper lateral extension 736 may be substantially parallel to the upper return leg 724 and the lower lateral wall 720. Further, the upper lateral extension 736 may extend inwardly from the outer wall 732. An upper inner wall 738 can extend in an upward direction from the upper lateral extension 736. In particular, the upper inner wall 738 may be substantially perpendicular to the upper lateral extension 736. Further, the upper inner wall 738 may be coplanar with the lower inner wall 722 and when the siding panel 700 is installed on an outer wall of a structure, the lower inner wall 722 and the upper inner wall 738 may contact an outer surface of the outer wall of the structure.

FIG. 10 further indicates that hanger section 716 of the siding body 702 of the siding panel 700 may further include an upper converging bend 740 that can turn approximately 180 degrees from the upper inner wall 738 and connect to a tab 742 that faces in a downward direction, i.e., toward the lower edge 704 of the siding body 702. The tab 742 is substantially parallel to the upper inner wall 738. The fold formed by the tab 742 increases the rigidity of the siding body 702, which can ease handling of the siding panel 700 during installation. Moreover, the fold can increase wind-load performance of the siding panel 700 after it is installed on an exterior wall of a structure.

A fastener zone 744 may be established below the fold formed by the tab 742 and a portion of the upper inner wall 738. The fastener zone 744 may include one or more fastener slots 746 through which one or more fasteners, e.g., a nail or a screw, may be driven through in order to secure the siding panel 700 to an outer wall of a building or structure. As illustrated, the fastener slots 746 can extend through the upper portion of the inner wall 738 adjacent to the tab 742. In a particular aspect, the fastener slots 746 can be equally spaced along the width of the siding panel 700, as indicated in FIG. 7. For example, the fastener slots 746 can be formed along the width of the siding panel 700 so that two slots may be spaced apart at every sixteen inches (16") to mirror the typical placement of wall studs in load bearing walls. In another aspect, the fastener slots 746 can be formed along the width of the siding panel 700 at every twenty-four inches (24) to mirror the placement of wall studs in some non-load bearing walls or some garage walls.

FIG. 10 also shows that the hanger section 716 of the siding body 702 of the siding panel 700 may include a recessed locking section 748 that is formed within, or is bound by, lower lateral wall 720, the lower inner wall 722, the upper return leg 724, the inner curve 726, and the intermediate outer wall 728. In a particular aspect, and as described in greater detail below in conjunction with FIG. 12 and FIG. 13, the recessed locking section 748 of the hanger section 716 can be configured to receive a flange, e.g., a locking loop of a locking arm, of an adjacent siding panel when the adjacent siding panel is properly installed over and engaged with the siding panel 700 illustrated in FIG. 12, described below.

As illustrated in FIG. 10, the hanger section 716 of the siding body 702 can further include an opening 750 that may be established near the upper edge 706 of the siding body 702 between a flattened area 752 just below the intermediate outer wall 728 of the hanger section 716 and the upper extension portion 712 of the siding body 702. In a particular aspect, the flattened area is substantially parallel to the siding body 702. In another aspect, the siding body 702 may have a slight arch and the flattened area 752 may also have a slight arch to match the arch of the siding body 702. In an assembled form, a protrusion, or lower locking section, of another siding panel may be fitted through the opening 750 of the hanger section 714 of the siding panel 700. The opening 750 may include a width, $W_O$, that can be defined by the closest linear distance between an inner face of intermediate outer wall 728 of the hanger section 716 and the outer face of the upper extension portion 712. The width of the opening 750 is designed to help the hanger section 716 engage a lower locking section of an adjacent siding panel in an interference fit in order to lock two adjacent panels together when installed as described in greater detail below. It is to be understood that $W_O$ is substantially uniform along the length of the opening 750.

FIG. 10 also shows that the recessed locking section 748 may further include a recessed area 754. The recessed area 754 is bound by the lower lateral wall 720, the lower inner wall 722 and the upper return leg 724.

Referring now to FIG. 9 and FIG. 11*a*, the siding body 702 of the siding panel 700 can further include a protrusion, i.e., a lower locking section 760, formed at, or near, the lower edge 704 of the siding body 702. A portion of the lower locking section 760 is recessed behind the lower extension portion 708. Specifically, as best viewed in FIG. 11*a*, the lower locking section 760 can include a lower return leg 762 that can extend inwardly from the lower edge 704 of the siding body 702. The lower return leg 762 may be substantially parallel to the central return leg 710. Further, an upwardly extending lip 764 can extend in a generally upward direction from the lower return leg 762, i.e., toward the upper edge 706 of the siding body 702 of the siding panel 700. While the upwardly extending lip 764 is shown at a slight angle with respect to a longitudinal axis of the siding panel 700, it can be appreciated that the upwardly extending lip 764 may be substantially parallel to the longitudinal axis.

FIG. 11*a* further indicates that the lower locking section 760 can also include a flange positioned at an end of the upwardly extending lip 764. For example, as shown, the flange can include a lock loop 766 that can extend generally in an inward direction from the upward extending lip 764. In particular, the lock loop 766 may include a first bend 768 that extends generally inward and connects to a flat portion 770 that extends further inward and slightly downward. A second bend 772 can extend from the flat portion 770 in a generally outward direction and can form a lateral extension 774 that can terminate in a tip 776 of the lock loop 766. The lateral extension 774 may be perpendicular to a longitudinal axis of the siding body 702.

In a particular aspect, when the siding panel 700 is engaged with anther siding panel, as described in detail below, the lateral extension 774 of the lower locking section 760 can overlay a lower lateral wall of a hanger section of another siding panel. Further, the lateral extension 774 of the lower locking section 760 can overlay the lower lateral wall of the hanger section of another siding panel in assembled form such that the siding panel 700 and the other siding panel have an interference fit.

As described in greater detail below in conjunction with FIG. 12 and FIG. 13, the lock loop 766 of the lower locking section 760 can be inserted into and engage the hanger section of an adjacent siding panel. Specifically, the lock loop 766 can be inserted into a recessed locking section of an adjacent siding panel. FIG. 11*a* further indicates that the lock loop 766 can include an overall width, $W_L$, that can be defined as the largest linear distance between an outer face of the upward extending lip 764 and an innermost surface of the second bend 772 of the lock loop 766.

In a particular aspect, $W_L$ may be larger than the width, $W_O$, of the opening 750 in the hanger section 716 of the siding panel 700. For example, $W_L$ can be at least $1.05 \times W_O$. Further, $W_L$ can be at least $1.1 \times W_O$, such as at least $1.25 \times W_O$, at least $1.5 \times W_O$, at least $1.75 \times W_O$, or at least $2.0 \times W_O$. In another aspect, $W_L$ may be no greater than $3.0 \times W_O$. Further, $W_L$ may be no greater than $2.75 \times W_O$, such as no greater than $2.5 \times W_O$, or no greater than $2.25 \times W_O$. It is to be understood that $W_L$ may be within a range between, and including, any of the maximum or minimum values of $W_L$ disclosed herein. Since $W_L$ is greater than $W_O$, when two adjacent panels are installed on an exterior wall of a structure as described below, this configuration can allow the lower locking section of one panel to be snapped into place within the hanger section of an adjacent panel and interlock the two panels.

In a particular aspect, the siding body 702 can be manufactured from a material that includes a composite material. The composite material may include a polymeric material. Further, the polymeric material can include polyvinyl chloride. In a particular aspect, the reinforcement panel 714 can include a foam layer affixed to the rear surface of the siding body 702 of the siding panel 700. The foam layer can be affixed to the rear surface of the siding body 702 using an adhesive. Further, the foam layer can include a rigid foam insulating material. For example, the reinforcement panel 714, or foam layer, can include a polyisocyanurate foam insulating material. Further, the polyisocyanurate foam insulating material can include a closed-cell polyisocyanurate foam insulating material. In another aspect, the reinforcement panel 714, or foam layer, can include a polystyrene foam insulating material. For example, the polystyrene foam insulating material can include an extruded polystyrene foam insulating material. In another aspect, the polystyrene foam insulating material can include an expanded polystyrene foam insulating material.

Figure 11B:
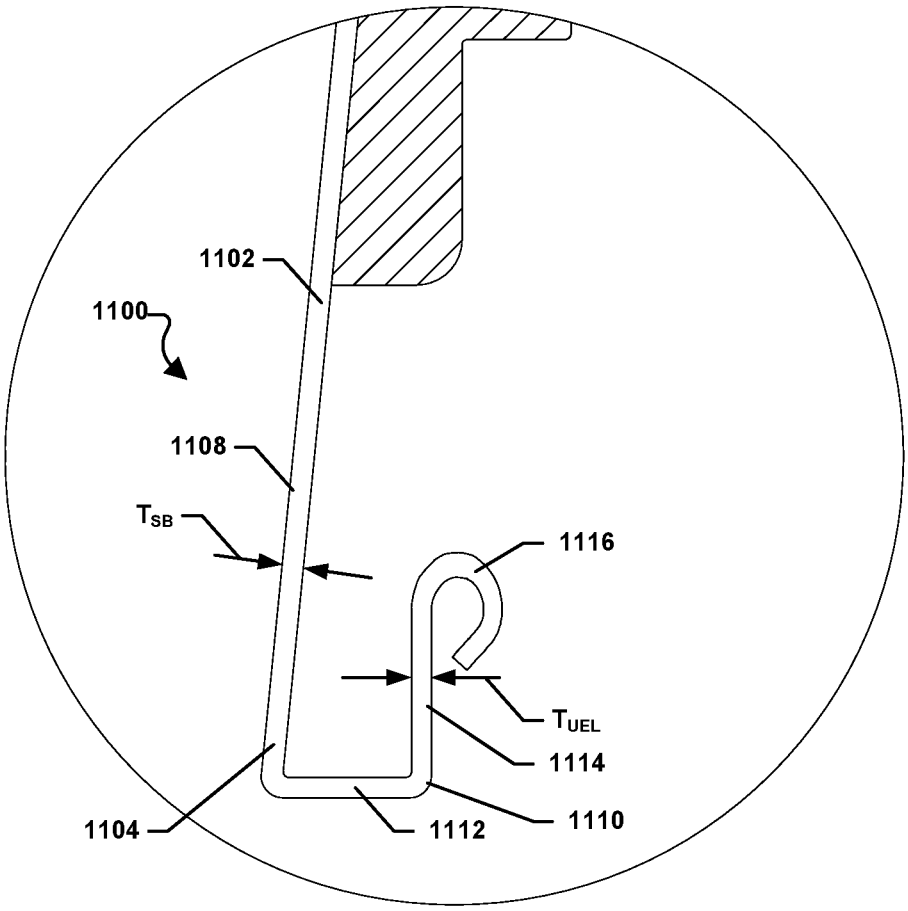
FIG. 11*b* includes an illustration of a detail view of a siding panel in accordance with an embodiment.

Referring to FIG. 11*b*, a lower portion of an alternative embodiment of a siding panel 1100 is shown. As indicated in FIG. 11*b*, the siding panel 1100 includes a siding body 1102 that includes a lower edge 1104 and a lower extension portion 1108. A protrusion, i.e., a lower locking section 1110, is formed at, or near, the lower edge 1104 of the siding body 1102. A portion of the lower locking section 1110 is recessed behind the lower extension portion 1108.

Specifically, the lower locking section 1110 can include a lower return leg 1112 that can extend inwardly from the lower edge 1104 of the siding body 1102. The lower return leg 1112 may form an angle with respect to the lower extension portion 1108 that is less than ninety degrees) (90°). An upward extending lip 1114 can extend in a generally upward direction from the lower return leg 1112. In a particular aspect, the upward extending lip 1114 may be substantially parallel to a longitudinal axis of the siding panel 1100 and a distance measured between the upward extending lip 1114 and the lower extension portion 1108 may be narrower near a top of the upwardly extending lip 1114 than near a base of the upward extending lip 1114.

FIG. 11*b* further indicates that the lower locking section 1110 can also include a flange positioned at an end of the upwardly extending lip 1114. For example, as shown, the flange can include a lock loop 1116 that can extend generally in an inward direction from the upward extending lip 1114. In particular, the lock loop 1116 is generally an elliptical loop extending from a distal end of the upwardly extending lip 1114. In a particular aspect, the lock loop 1116 of the lower locking section 1110 can be inserted into an engage the hanger section of an adjacent siding panel. Specifically, the lock loop 1116 can be inserted into a recessed locking section of an adjacent siding panel.

FIG. 11*b* further indicates that the siding body 1102 can have a thickness, $T_{SB}$, that can be measured between a front face of the siding body 1102 and a rear face of the siding body 1102. Also, as illustrated in FIG. 11*b*, the upwardly extending lip 1114 can also include a thickness, $T_{UEL}$, that can be measured between a front face of the upwardly extending lip 1114 and a rear face of the upwardly extending lip 1114. In a particular aspect, $T_{SB}$ can be greater than or equal to $T_{UEL}$. For example, $T_{SB}$ can be at least 1.5 times greater than $T_{UEL}$. Further, $T_{SB}$ can be at least 2.0 times greater than $T_{UEL}$, such as at least 2.5 times greater than $T_{UEL}$, at least 3.0 times greater than $T_{UEL}$, at least 3.5 times greater than $T_{UEL}$, or at least 4.0 times greater than $T_{UEL}$. In another aspect, $T_{SB}$ is less than 10.0 times greater than $T_{UEL}$, such as less than 9.5 times greater than $T_{UEL}$, less than 9.0 times greater than $T_{UEL}$, less than 8.5 times greater than $T_{UEL}$, less than 8.0 times greater than $T_{UEL}$, less than 7.5 times greater than $T_{UEL}$, less than 7.0 times greater than $T_{UEL}$, less than 6.5 times greater than $T_{UEL}$, less than 6.0 times greater than $T_{UEL}$, less than 5.5 times greater than $T_{UEL}$, or less than 5.0 times greater than $T_{UEL}$. In a particular aspect, $T_{SB}$ can be within a range between and including any of the minimum and maximum values of $T_{SB}$ described above. In another aspect, $T_{UEL}$ may be greater than $T_{SB}$.

It can be appreciated that the difference in thickness between the siding body 1102 and the upwardly extending lip 1114 may allow the upwardly extending lip 1114 to be more flexible than the siding body 1102. Moreover, in a particular aspect, the upper portion (not shown) of the siding panel 1100 illustrated in FIG. 11*b* can be configured substantially identical to the upper portion of the siding panel 700 illustrated in FIG. 7 through FIG. 11*a*.

Siding Panel Assembly

Figure 12:
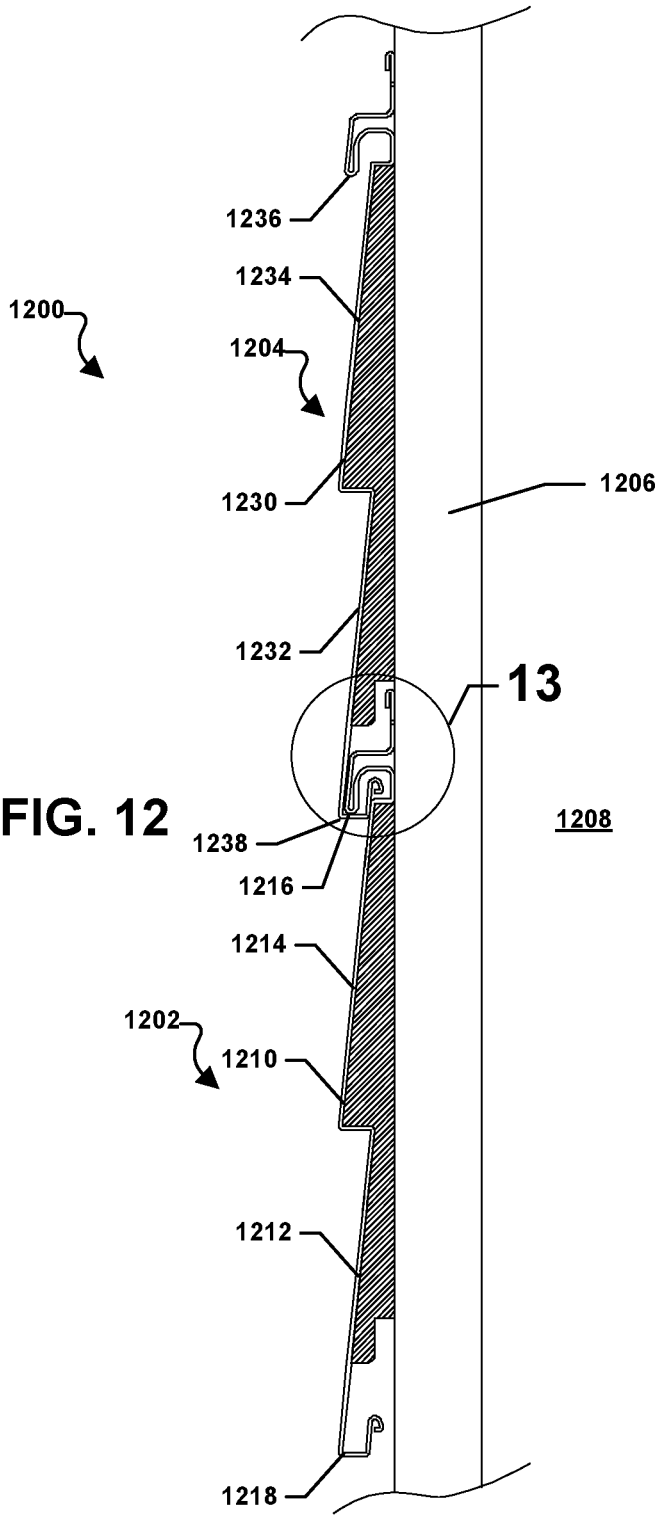
FIG. 12 includes an illustration of a side plan view of two adjacent house siding panels in accordance with an embodiment.

FIG. 12 illustrates a siding panel assembly generally designated 1200. In particular, FIG. 12 illustrates a side plan view of the siding panel assembly 1200. As shown, the siding panel assembly 1200 can include a first siding panel 1202 and a second siding panel 1204 attached to, or otherwise affixed to, an outer wall 1206 of a structure 1208. Moreover, as shown, the first siding panel 1202 and the second siding panel 1204 can be installed horizontally on the outer wall 1206 of the structure 1208 so that a back surface of each siding panel 1202, 1204 is in contact with an outer surface of the outer wall 1206 of the structure 1208. In another aspect, the siding panels 1202, 1204 may be installed over a weather proof barrier, i.e., house wrap, that may be installed on the outer wall 1206 of the structure 1208. In such a case, the house wrap would be sandwiched between the outer surface of the outer wall 1206 of the structure 1208 and the back surfaces of the siding panels 1202, 1204.

As illustrated, the second siding panel 1204 is installed above, and slightly overlaps, the first siding panel 1202. The first siding panel 1202 and the second siding panel 1204 may be configured substantially identical to the siding panel 100 described in conjunction with FIG. 7 through FIG. 11*a*. Alternatively, the first siding panel 1202 and the second siding panel 1204 may be configured substantially identical to the siding panel 1100 described in conjunction with FIG. 11*b*.

Particularly, the first siding panel 1202 may include a siding body 1210 having a lower extension 1212 and an upper extension 1214. Further, the siding body 1210 of the first siding panel 1202 can include a hanger section 1216 and a lower locking section 1218. As shown in FIG. 13, the hanger section 1216 of the siding body 1210 of the first siding panel 1202 may include a recessed locking section 1220. Further, the first siding panel 1202 may include an opening 1222 that is defined by the hanger section 1216 and the siding body 1210. In addition, the hanger section 1216 can include a lower converging bend 1224 and an inner curve 1226 extending therefrom.

Figure 13:
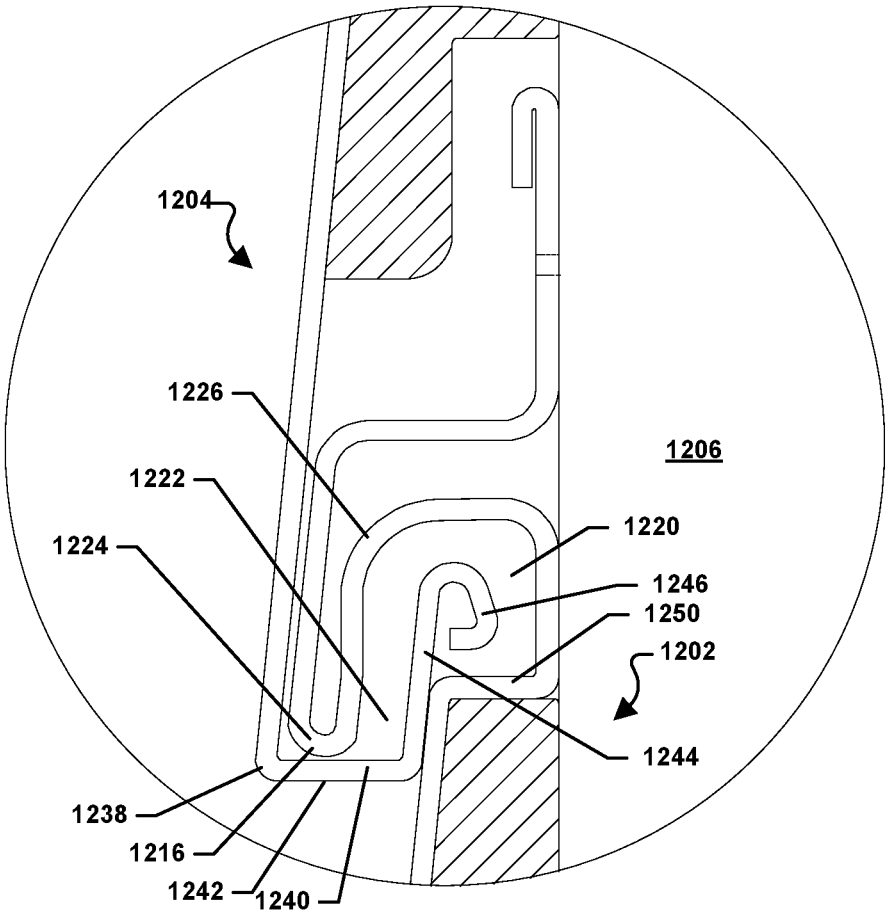
FIG. 13 includes an illustration of a detail view of two adjacent house siding panels in accordance with an embodiment taken at Circle 13 in FIG. 12.

The second siding panel 1204, illustrated in FIG. 12 and FIG. 13, may also include a siding body 1230 having a lower extension 1232 and an upper extension 1234. Moreover, the siding body 1230 of the second siding panel 1204 can include a hanger section 1236 and a lower locking section 1238. As more clearly indicated in FIG. 13, the lower locking section 1238 of the siding body 1230 of the second siding panel 1204 can include a lower return leg 1240 extending from a lower edge 1242 of the second siding panel 1204. Further, the lower locking section 1238 can include an upwardly extending lip 1244 that can terminate in a flange, i.e., a lock loop 1246. While the upwardly extending lip 1244 is shown at a slight angle with respect to a longitudinal axis of the siding panels 1202, 1204, it can be appreciated that the upwardly extending lip 1244 may be substantially parallel to the longitudinal axis.

As illustrated in FIG. 12, the first siding panel 1202 may be installed on the outer wall 1206 of the structure 1208 first. Thereafter, the second siding panel 1204 may be installed on the outer wall 1206. The second siding panel 1204, i.e., the upper siding panel, can be installed above the first siding panel 1202 and the second siding panel 1204 can slightly overlap and engage the first siding panel 1202, i.e., the lower siding panel. Specifically, as shown in detail in FIG. 13, the lower locking section 1238 of the second siding panel 1204 can engage the hanger section 1216 of the first siding panel 1202. In particular, the upwardly extending lip 1244 of the second siding panel 1204 is configured to penetrate, and extend through, the opening 1222 of the first siding panel 1202 so that the flange, e.g., the lock loop 1246, engages the upper extension portion 1214 of the first siding panel 1202 and can be maneuvered upward into the recessed locking section 1220 of the hanger section 1216 of the first siding panel 1202 in order to create an interference fit between the second siding panel 1204 and the first siding panel 1202.

Further, as illustrated in FIG. 13, when the first siding panel 1202 and the second siding panel 1204 are properly installed on the outer wall 1206 of the structure 1208, the lock loop 1246 of the lower locking section 1238 of the second siding panel 1204 can be disposed within the recessed locking section 1220 of the hanger section 1216 of the first siding panel 1202. Moreover, the converging bend 1224 of the hanger section 1216 of the first siding panel 1202 may contact the lower return leg 1240 of the lower locking section 1238 of the second siding panel 1204. It can be appreciated that the contact between the converging bend 1224 and the lower return leg 1240 may prevent contact between other parts of the hanger section 1216 of the first siding panel 1202, e.g., the inner curve 1226. Moreover, the lock loop 1246 may rest on a lower lateral wall 1250 of the first siding panel 1202 to create an interference fit.

FIG. 13 also indicates that when the first siding panel 1202 and the second siding panel 1204 are installed on the vertical wall 1206 of the structure 1208 and the second siding panel 1204 is engaged and interlocked with the first siding panel 1202, the upwardly extending lip 1244 of the second siding panel 1204 can contact the upper extension 1214 of the first siding panel 1202. Further, the lower return leg 1240 of the second siding panel 1204 can provide an upward force to the hanger section 1216 of the first siding panel 1202.

Siding Panel

Figure 14:
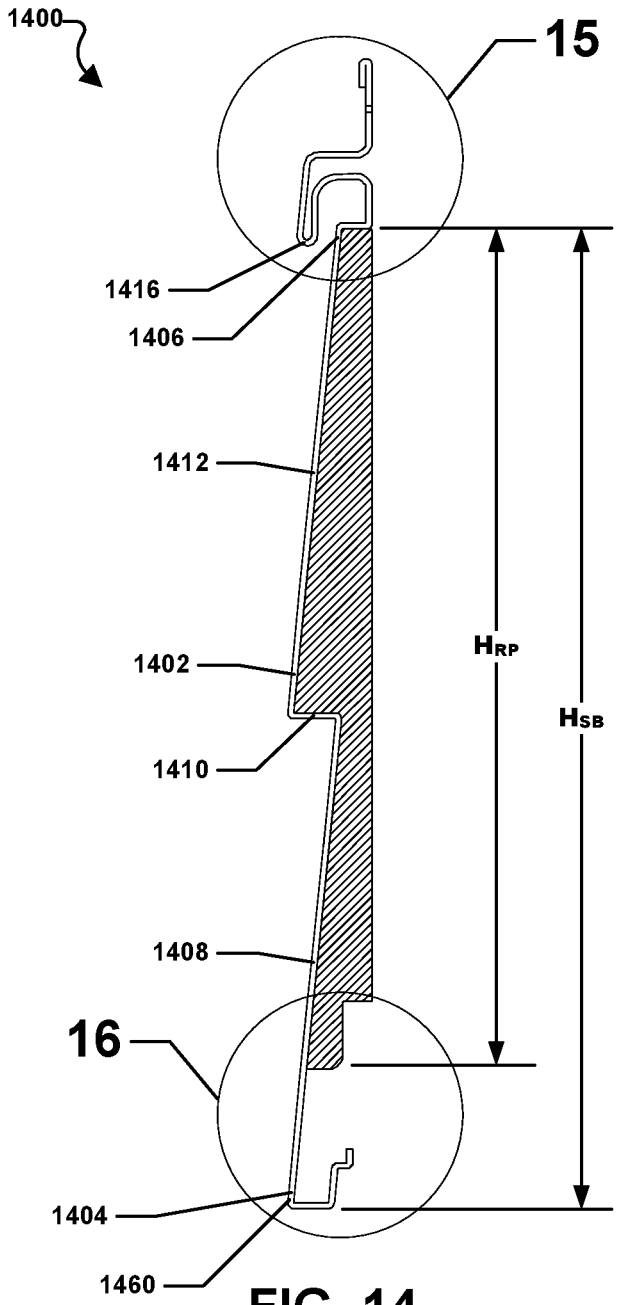
FIG. 14 includes an illustration of a side plan view of a house siding panel in accordance with an embodiment.
Figure 15:
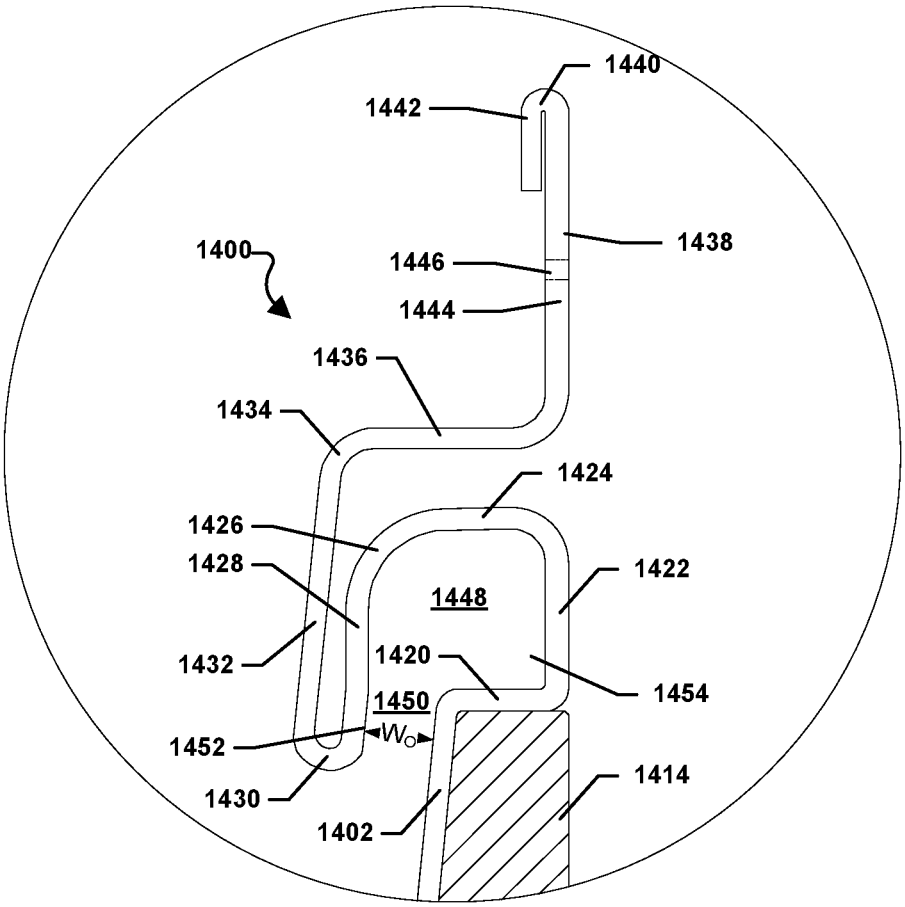
FIG. 15 includes an illustration of a detail view of a siding panel in accordance with an embodiment taken at Circle 15 in FIG. 14.
Figure 16:
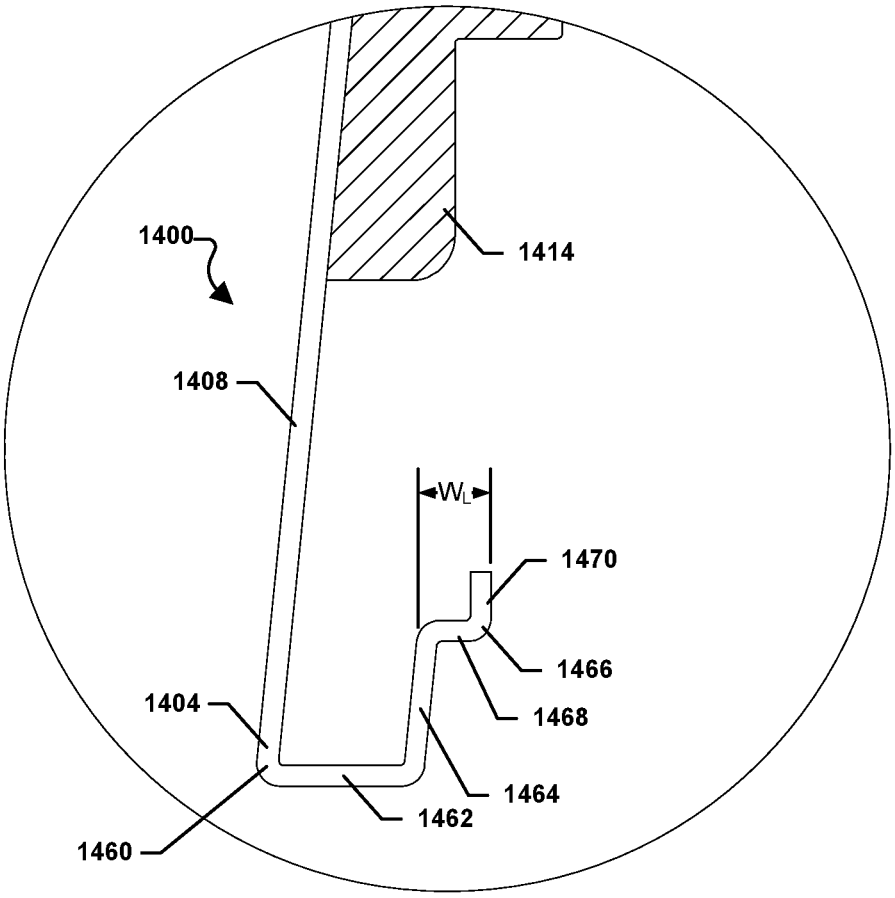
FIG. 16 includes an illustration of a detail view of a siding panel in accordance with an embodiment taken at Circle 16 in FIG. 14.

Referring now to FIG. 14 through FIG. 16, another siding panel is illustrated and is generally designated 1400. FIG. 14 illustrates a side plan view of the siding panel 1400. FIG. 15 includes a detailed view of the siding panel 1400 taken at Circle 15 in FIG. 14. FIG. 16 includes a detailed view of the siding panel 1400 taken at Circle 16 in FIG. 14. As shown in FIG. 14, the siding panel 1400 can include a siding body 1402 that can extend between a lower edge 1404 and an upper edge 1406. The siding panel 1400 can include a lower extension portion 1408 that can extend from the lower edge 1404 of the siding body 1402 to a central return leg 1410. Further, the siding panel 1400 can include an upper extension portion 1412 that can extend from the central return leg 1410 to the upper edge 1406 of the siding body 1402. When the siding panel 1400 is installed on a structure, the lower extension portion 1408 and the upper extension portion 1412 are configured to visually simulate single courses of overlapping wooden siding where the overlap is simulated by the central return leg 1410. The central return leg 1410 may also act as a ridge that can extend laterally across a width of the siding body 1402.

As illustrated, the siding panel 1400 can further include a reinforcement panel 1414 mated to, or otherwise disposed on, a rear surface of the siding panel 1400. In a particular aspect, the reinforcement panel 1414 can be affixed to the rear surface of the siding body 1402 of the siding panel 1400 using an adhesive material. The reinforcement panel 1414 can extend along a majority of a height of the siding body 1402 of the siding panel 1400, i.e., a height measured between the lower edge 1404 of the siding body 1402 and the upper edge 1406 of the siding body 1402.

Specifically, the reinforcement panel 1414 can extend along the entirety of the back side of the upper extension portion 1412. Further, the reinforcement panel 1414 can extend along a majority of the lower extension portion 1408. In particular, the reinforcement panel 1414 can include a height, $H_{RP}$. $H_{RP}$ can be measured from the upper edge of the reinforcement panel to the lower end of the reinforcement panel. The siding body 1402 of the siding panel 1400 may also include a height, $H_{SB}$. $H_{SB}$ can be measured from the upper edge 1406 of the siding body 1402 to the lower edge 1404 of the siding body 1402.

As indicated in FIG. 14, $H_{RP}$ may be less than $H_{SB}$. For example, $H_{RP}$ may be less than 95% $H_{SB}$. Further, $H_{RP}$ may be less than 94% $H_{SB}$, such as less than 94% $H_{SB}$, less than 93% $H_{SB}$, less than 92% $H_{SB}$, less than 91% $H_{SB}$, or less than 90% $H_{SB}$. In another aspect, $H_{RP}$ may be at least 80% $H_{SB}$, such as at least 81% $H_{SB}$, at least 82% $H_{SB}$, at least 83% $H_{SB}$, at least 84% $H_{SB}$, or at least 85% $H_{SB}$. It is to be understood that $H_{RP}$ may be within a range between, and including, any of the maximum or minimum values of H disclosed herein.

FIG. 14 and FIG. 15 indicate that the siding panel 1400 can include a hanger section 1416 that can extend outwardly and upwardly from the upper edge 1406 of the siding body 1402. It is to be understood the outward direction is the direction away from the wall on which the siding panel 1400 may be installed. Further, the siding panel 1400 may be installed so that the reinforcement panel 1414 is immediately adjacent to, or closest to, a wall of the building or structure on which the siding panel 1400 is installed.

Specifically, the hanger section 1416 can include a lower lateral wall 1420 that can extend inwardly from the upper edge 1406 of the siding body 1402. The lower lateral wall 1420 can be substantially perpendicular to a longitudinal axis of the siding panel 1400. The lower lateral wall 1420 of the hanger section 1416 of the siding body 1402 can act as a guide or alignment feature for disposition of the reinforcement panel 1414 on the rear surface of the siding panel 1400.

An inner wall 1422 can extend in an upward direction from the lower lateral wall 1420. In a particular aspect, the lower inner wall 1422 can be substantially perpendicular to the lower lateral wall 1420. Further, as illustrated, an upper return leg 1424 can extend outwardly from the lower inner wall 1422. In particular, the upper return leg 1424 can be perpendicular to the lower inner wall 1422. Moreover, the upper return leg 1424 may be parallel to the lower lateral wall 1420. An inner curve 1426 can extend from the upper return leg 1424 and can curve in a downward direction, i.e., toward the lower edge 1404 of the siding body 1402. In addition, the inner curve 1426 can connect to an intermediate outer wall 1428.

As further shown in FIG. 15, a lower converging bend 1430 can extend from the intermediate outer wall 1428 and can turn nearly 180 degrees and an outer wall 1432 can extend in an upward direction from the lower converging bend 1430. An outer curve 1434 can connect an upper lateral extension 1436 to the outer wall 1432. The upper lateral extension 1436 may be substantially parallel to the upper return leg 1424 and the lower lateral wall 1420. Further, the upper lateral extension 1436 may extend inwardly from the outer wall 1432. An upper inner wall 1438 can extend in an upward direction from the upper lateral extension 1436. In particular, the upper inner wall 1438 may be substantially perpendicular to the upper lateral extension 1436. Further, the upper inner wall 1438 may be coplanar with the lower inner wall 1422 and when the siding panel 1400 is installed on an outer wall of a structure, the lower inner wall 1422 and the upper inner wall 1438 may contact an outer surface of the outer wall of the structure.

FIG. 15 further indicates that hanger section 1416 of the siding body 1402 of the siding panel 1400 may further include an upper converging bend 1440 that can turn approximately 180 degrees from the upper inner wall 1438 and connect to a tab 1442 that faces in a downward direction, i.e., toward the lower edge 1404 of the siding body 1402. The tab 1442 is substantially parallel to the upper inner wall 1438. The fold formed by the tab 1442 increases the rigidity of the siding body 1402, which can ease handling of the siding panel 1400 during installation. Moreover, the fold can increase windload performance of the siding panel 1400 after it is installed on an exterior wall of a structure.

A fastener zone 1444 may be established below the fold formed by the tab 1442 and a portion of the upper inner wall 1438. It can be appreciated that the fastener zone 1444 may be formed with one or more fastener slots 1446 through which the fasteners may be inserted. As illustrated, the fastener slots 1446 can extend through the tab 1442 and the upper portion of the upper inner wall 1438 adjacent to the tab 1442. In a particular aspect, the fastener slots 1446 can be equally spaced along the width of the siding panel 1400, as indicated in FIG. 14. For example, the fastener slots 1446 can be formed along the width of the siding panel 1400 such that two pairs of fastener slots 1446 are space apart by sixteen inches (16") to mirror the typical placement of wall studs in load bearing walls. In another aspect, pairs of fastener slots 1446 can be spaced apart by twenty-four inches (24) to mirror the placement of wall studs in some non-load bearing walls or some garage walls.

FIG. 15 further indicates the hanger section 1416 of the siding body 1402 of the siding panel 1400 may further include a recessed locking section 1448 that is formed within, or is bound by, the lower lateral wall 1420, the lower inner wall 1422, the upper return leg 1424, the inner curve 1426, and the intermediate outer wall 1428. In a particular aspect, and as described in greater detail below in conjunction with FIG. 17 and FIG. 18, the recessed locking section 1448 of the hanger section 1416 can be configured to receive a locking flange of an adjacent siding panel when the adjacent siding panel is properly installed over and engaged with the siding panel 1400 illustrated in FIG. 14.

FIG. 15 also indicates that the hanger section 1416 of the siding body 1402 can further include an opening 1450 that may be established near the upper edge 1406 of the siding body 1402 between a flattened area 1452 just below the intermediate outer wall 1428 of the hanger section 1416 and the upper extension portion 1412. The opening 1450 may include a width, $W_O$, that can be defined by the closest linear distance between an inner face of intermediate outer wall 1428 of the hanger section 1416 and the outer face of the upper extension portion 1412. The width of the opening 1450 is designed to help the hanger section 1416 guide lower locking section of an adjacent siding panel into the recessed locking section in an interference fit in order to lock two adjacent panels together when installed as described in greater detail below.

FIG. 15 also shows that the recessed locking section 1448 may further include a recessed area 1454. The recessed area 1454 is bound by the lower lateral wall 1420, the lower inner wall 1422 and the upper return leg 1424.

Referring now to FIG. 14 and FIG. 16, the siding body 1402 of the siding panel 1400 can further include a protrusion, i.e., a lower locking section 1460, formed at, or extending from, the lower edge 1404 of the siding body 1402. A portion of the lower locking section 1460 is recessed behind the lower extension portion 1408. In particular, as best viewed in FIG. 16, the lower locking section 1460 can include a lower return leg 1462 that can extend inwardly from the lower edge 1404 of the siding body 1402. The lower return leg 1462 may be substantially parallel to the central return leg 1410. Further, an upward extending lip 1464 can extend in a generally upward direction from the lower return leg 1462, i.e., toward the upper edge 1406 of the siding body 1402 of the siding panel 1400.

FIG. 16 further indicates that the lower locking section 1460 can also include a flange positioned at an end of the upwardly extending lip. For example, the flange can include a locking flange 1466 that can extend generally in an inward direction from the upward extending lip 1464 so that the locking flange 1466 is substantially perpendicular to a longitudinal axis of the siding panel 1400. In particular, the locking flange 1466 may include a lateral extension 1468 that is substantially parallel to a longitudinal axis of the siding panel 1400. Further, the locking flange 1466 can include a second upwardly extending lip 1470 that extends from, and is substantially perpendicular to, the lateral extension 1468.

As described in greater detail below in conjunction with FIG. 17 and FIG. 18, the locking flange 1466 of the lower locking section 1460 can be inserted into an engage the hanger section of an adjacent siding panel. Specifically, the locking flange 1466 can be inserted into a recessed locking section of an adjacent siding panel. FIG. 16 further indicates that the locking flange 1466 can include an overall width, $W_L$, that can be defined as the largest linear distance between an outer face of the upward extending lip 1464 at the transition to the lateral extension 1468 and an innermost surface of the second upwardly extending lip 1470 of the locking flange 1466.

In a particular aspect, $W_L$ may be larger than the width, $W_O$, of the opening 1450 in the hanger section 1416 of the siding panel 1400. For example, $W_L$ can be at least $1.05\times W_O$. Further, $W_L$ can be at least $1.1\times W_O$, such as at least $1.25\times W_O$, at least $1.5\times W_O$, at least $1.75\times W_O$, or at least $2.0\times W_O$. In another aspect, $W_L$ may be no greater than $3.0\times W_O$. Further, $W_L$ may be no greater than $2.75\times W_O$, such as no greater than $2.5\times W_O$, or no greater than $2.25\times W_O$. It is to be understood that $W_L$ may be within a range between, and including, any of the maximum or minimum values of $W_L$ disclosed herein. Since $W_L$ is greater than $W_O$, when two adjacent panels are installed on an exterior wall of a structure as described below, this configuration can allow the lower locking section of one panel to be snapped into place within the hanger section of an adjacent panel and interlock the two panels.

In a particular aspect, the siding body 1402 can be manufactured from a material that includes a composite material. The composite material may include a polymeric material. Further, the polymeric material can include polyvinyl chloride. In a particular aspect, the reinforcement panel 1414 can include a foam layer affixed to the rear surface of the siding body 1402 of the siding panel 1400. The foam layer can be affixed to the rear surface of the siding body 1402 using an adhesive. Further, the foam layer can include a rigid foam insulating material. For example, the reinforcement panel 1414, or foam layer, can include a polyisocyanurate foam insulating material. Further, the polyisocyanurate foam insulating material can include a closed-cell polyisocyanurate foam insulating material. In another aspect, the reinforcement panel 1414, or foam layer, can include a polystyrene foam insulating material. For example, the polystyrene foam insulating material can include an extruded polystyrene foam insulating material. In another aspect, the polystyrene foam insulating material can include an expanded polystyrene foam insulating material.

Siding Panel Assembly

Figure 17:
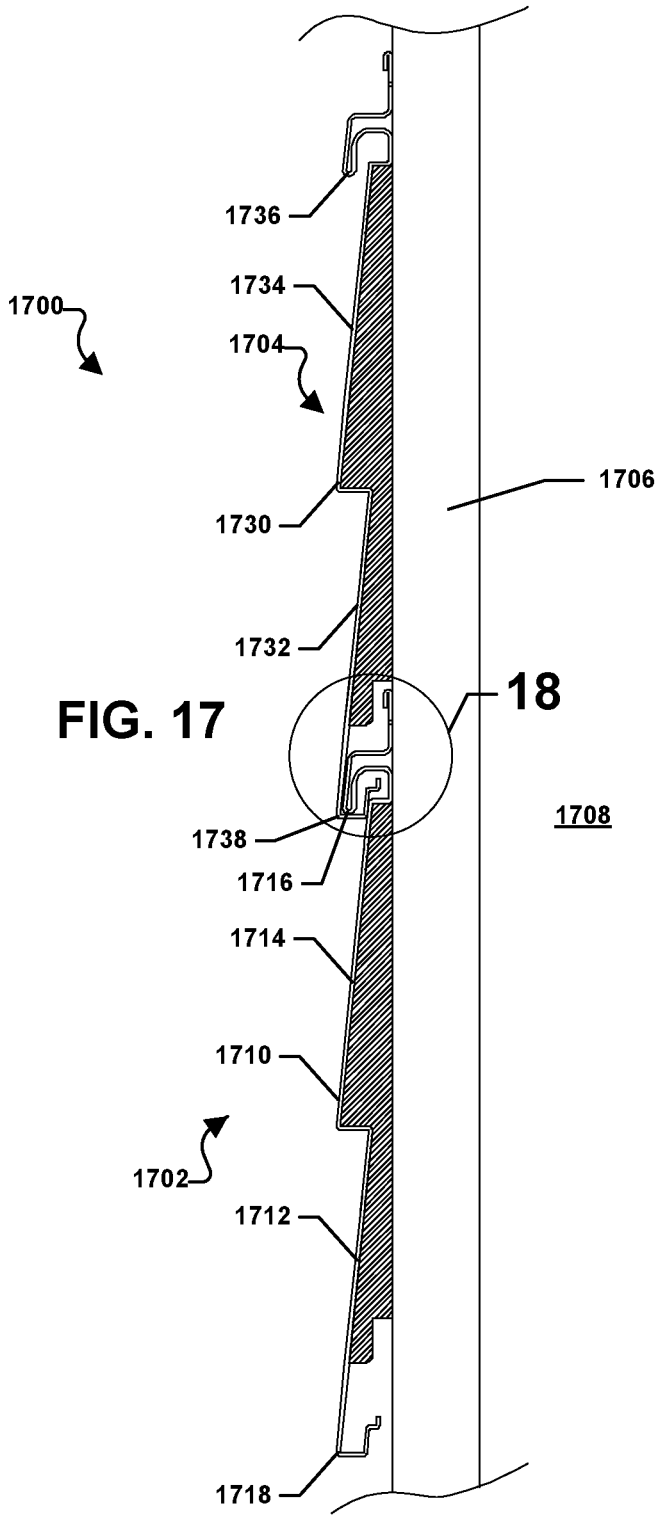
FIG. 17 includes an illustration of a side plan view of two adjacent house siding panels in accordance with an embodiment.

FIG. 17 illustrates a siding panel assembly generally designated 1700. In particular, FIG. 17 illustrates a side plan view of the siding panel assembly 1700. As shown, the siding panel assembly 1700 can include a first siding panel 1702 and a second siding panel 1704 attached to, or otherwise affixed to, an outer wall 1706 of a structure 1708. Additionally, the first siding panel 1702 and the second siding panel 1704 can be installed horizontally on the outer wall 1706 of the structure 1708 so that a back surface of each siding panel 1702, 1704 is in contact with an outer surface of the outer wall 1706 of the structure 1708. Alternatively, each siding panel 1702, 1704 may be in contact with house wrap (not shown) disposed on the outer wall 1706. Further, as illustrated, the second siding panel 1704 is installed above, and slightly overlaps, the first siding panel 1702. The first siding panel 1702 and the second siding panel 1704 may be configured substantially identical to the siding panel 1400 described in conjunction with FIG. 14 through FIG. 16.

Particularly, the first siding panel 1702 may include a siding body 1710 having a lower extension 1712 and an upper extension 1714. Further, the siding body 1710 of the first siding panel 1702 can include a hanger section 1716 and a lower locking section 1718. As shown in FIG. 18, the hanger section 1716 of the siding body 1710 of the first siding panel 1702 may include a recessed locking section 1720. Further, the first siding panel 1702 may include an opening 1722 that is defined by the hanger section 1716 and the siding body 1710. In addition, the hanger section 1716 can include a lower converging bend 1724 and an inner curve 1726 extending therefrom.

Figure 18:
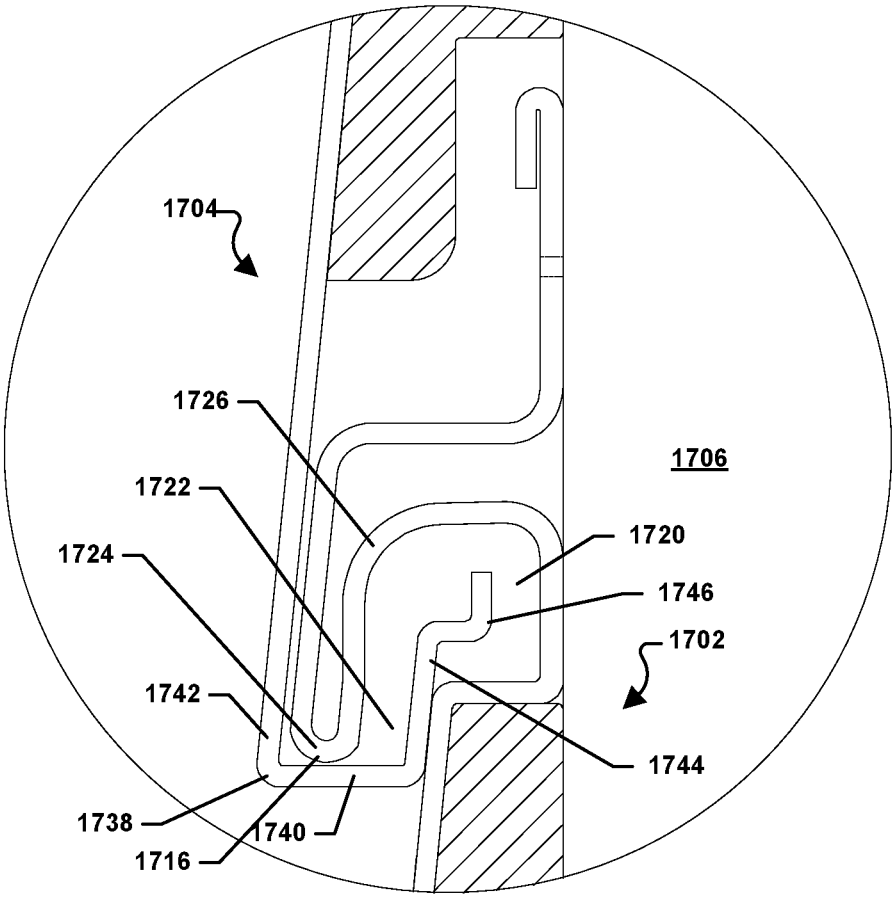
FIG. 18 includes an illustration of a detail view of two adjacent house siding panels in accordance with an embodiment taken at Circle 18 in FIG. 17.

The second siding panel 1704, illustrated in FIG. 17 and FIG. 18, may also include a siding body 1730 having a lower extension 1732 and an upper extension 1734. Moreover, the siding body 1730 of the second siding panel 1704 can include a hanger section 1736 and a lower locking section 1738. As more clearly indicated in FIG. 18, the lower locking section 1738 of the siding body 1730 of the second siding panel 1704 can include a lower return leg 1740 extending from a lower edge 1742 of the second siding panel 1704. Further, the lower locking section 1738 can include an upwardly extending lip 1744 that can terminate in a flange, i.e., a locking flange 1746. While the upwardly extending lip 1744 is shown at a slight angle with respect to a longitudinal axis of the siding panels 1702, 1704, it can be appreciated that the upwardly extending lip 1744 may be substantially parallel to the longitudinal axis.

As illustrated in FIG. 17, the first siding panel 1702 may be installed on the outer wall 1706 of the structure 1708 first. Thereafter, the second siding panel 1704 may be installed on the outer wall 1706. The second siding panel 1704, i.e., the upper siding panel, can be installed above the first siding panel 1702 and the second siding panel 1704 can slightly overlap and engage the first siding panel 1702, i.e., the lower siding panel. Specifically, as shown in detail in FIG. 18, the lower locking section 1738 of the second siding panel 1704 can engage the hanger section 1716 of the first siding panel 1702. In particular, the upwardly extending lip 1744 of the second siding panel 1704 is configured to penetrate, and extend through, the opening 1722 of the first siding panel 1702 so that the flange, e.g., the locking flange 1746, engages the upper extension portion 1714 of the first siding panel 1702 and can be maneuvered upward into the recessed locking section 1720 of the hanger section 1716 of the first siding panel 1702 in order to create an interference fit between the second siding panel 1704 and the first siding panel 1702.

Further, as illustrated in FIG. 18, when the first siding panel 1702 and the second siding panel 1704 are properly installed on the outer wall 1706 of the structure 1708, the locking flange 1746 of the lower locking section 1738 of the second siding panel 1704 can be disposed within the recessed locking section 1720 of the hanger section 1716 of the first siding panel 1702. Moreover, the converging bend 1724 of the hanger section 1716 of the first siding panel 1702 may contact the lower return leg 1740 of the lower locking section 1738 of the second siding panel 1704. It can be appreciated that the contact between the converging bend 1724 and the lower return leg 1740 may prevent contact between other parts of the hanger section 1716 of the first siding panel 1702, e.g., the inner curve 1726.

FIG. 18 also indicates that when the first siding panel 1702 and the second siding panel 1704 are installed on the vertical wall 1706 of the structure 1708 and the second siding panel 1704 is engaged and interlocked with the first siding panel 1702, the upwardly extending lip 1744 of the second siding panel 1704 can contact the upper extension 1714 of the first siding panel 1702. Further, the lower return leg 1740 of the second siding panel 1704 can provide an upward force to the hanger section 1716 of the first siding panel 1702.

Siding Panel

Figure 19:
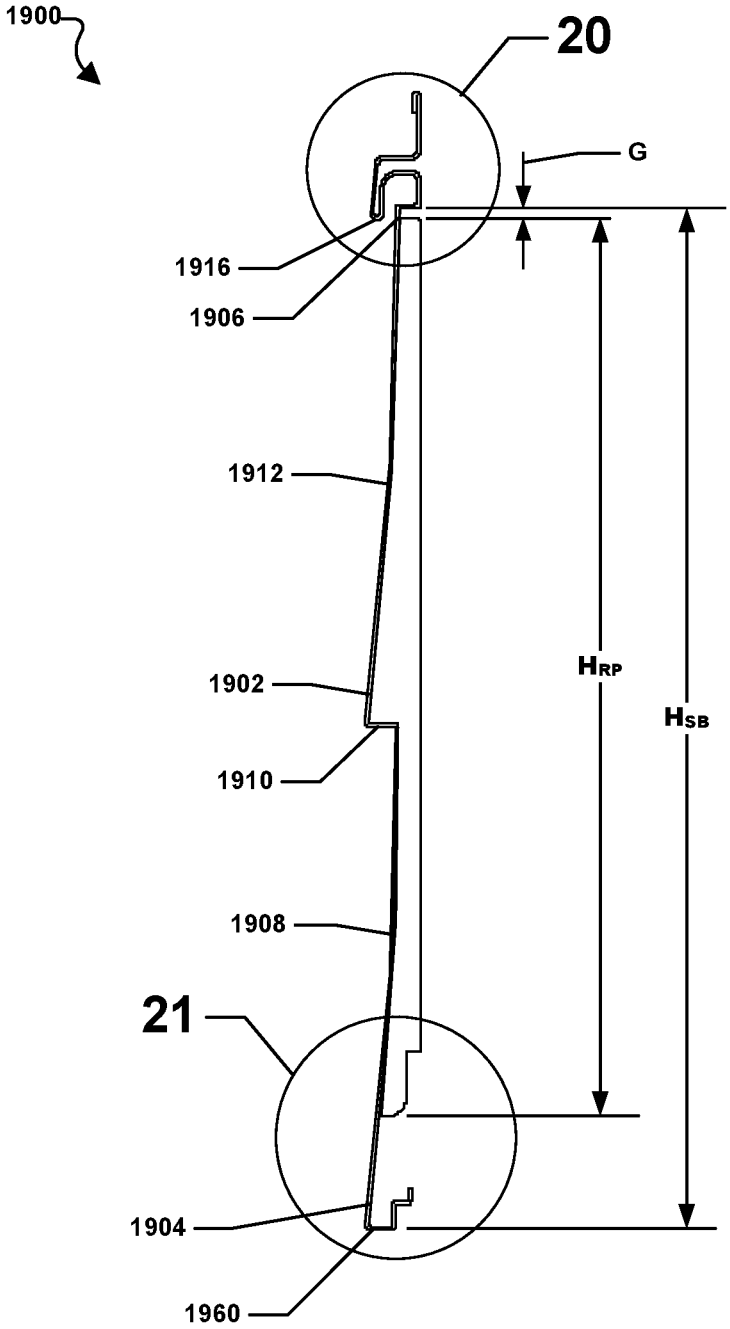
FIG. 19 includes an illustration of a side plan view of a house siding panel in accordance with an embodiment.
Figure 20:
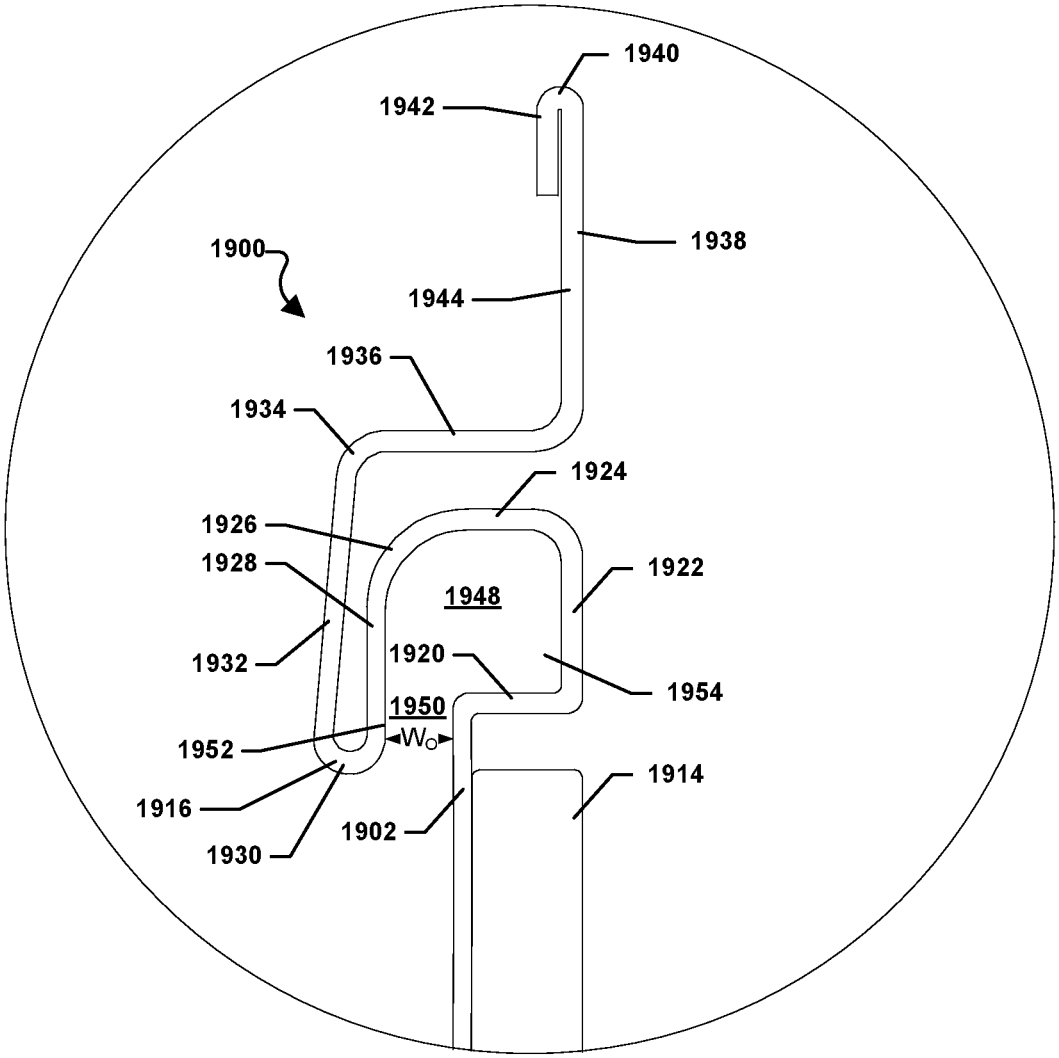
FIG. 20 includes an illustration of a detail view of a siding panel in accordance with an embodiment taken at Circle 20 in FIG. 19.
Figure 21:
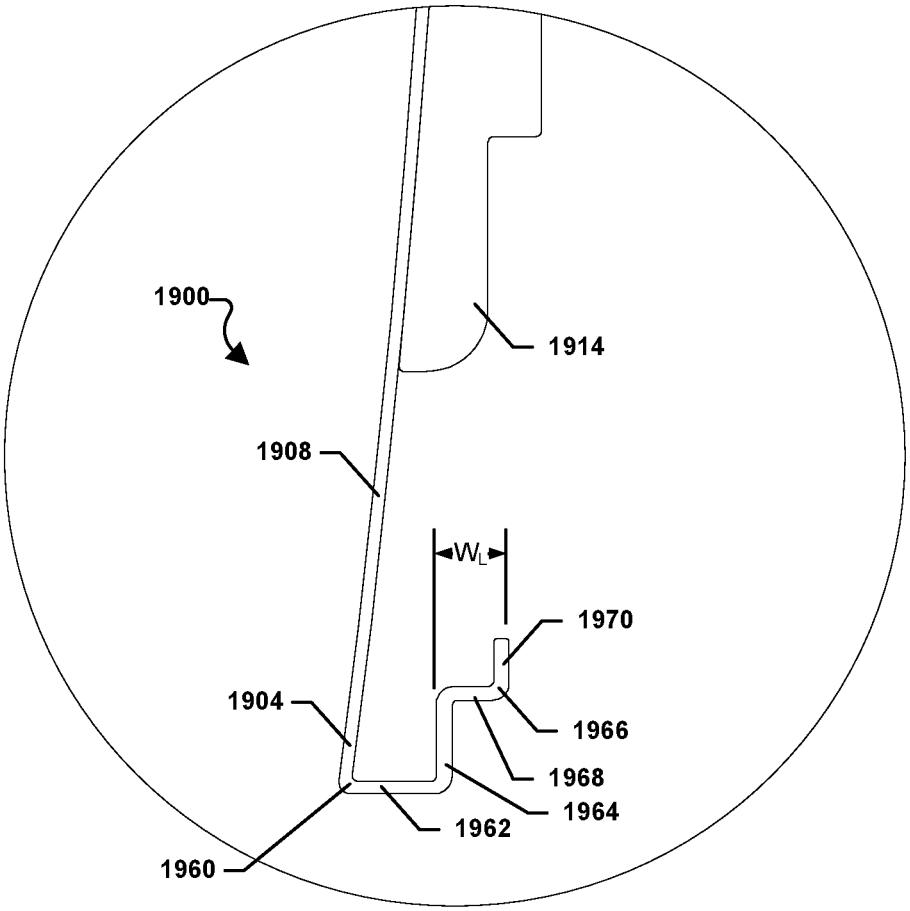
FIG. 21 includes an illustration of a detail view of a siding panel in accordance with an embodiment taken at Circle 21 in FIG. 19.

Referring now to FIG. 19 through FIG. 23, another siding panel is illustrated and is generally designated 1900. FIG. 19 illustrates a side plan view of the siding panel 1900. FIG. 20 includes a detailed view of the siding panel 1900 taken at Circle 20 in FIG. 19. FIG. 21 includes a detailed view of the siding panel 1900 taken at Circle 21 in FIG. 19.

As shown in FIG. 19, the siding panel 1900 can include a siding body 1902 that can extend between a lower edge 1904 and an upper edge 1906. The siding panel 1900 can include a lower extension portion 1908 that can extend from the lower edge 1904 of the siding body 1902 to a central return leg 1910. Further, the siding panel 1900 can include an upper extension portion 1912 that can extend from the central return leg 1910 to the upper edge 1906 of the siding body 1902. When the siding panel 1900 is installed on a structure, the lower extension portion 1908 and the upper extension portion 1912 are configured to visually simulate single courses of overlapping wood siding where the overlap is simulated by the central return leg 1910. The central return leg 1910 may also act as a ridge that can extend laterally across a width of the siding body 1902. It is to be understood that the extension portions 1908, 1912 are slightly arched or curved as shown in FIG. 19. In other words, the extension portions 1908, 1912 are not flat. However, the upper extension portion 1912 is flattened near the upper edge 1906 of the siding body 1902 so that an opening formed in a hanger portion has a width, $W_O$, that is uniform along the entire opening.

As illustrated, the siding panel 1900 can further include a reinforcement panel 1914 mated to, or otherwise disposed on, a rear surface of the siding panel 1900. In a particular aspect, the reinforcement panel 1914 can be affixed to the rear surface of the siding body 1902 of the siding panel 1900 using an adhesive material. The reinforcement panel 1914 can extend along a majority of a height of the siding body 1902 of the siding panel 1900, i.e., a height measured between the lower edge 1904 of the siding body 1902 and the upper edge 1906 of the siding body 1902.

Specifically, the reinforcement panel 1914 can extend along the entirety of the back side of the upper extension portion 1912. Further, the reinforcement panel 1914 can extend along a majority of the lower extension portion 1908. In particular, the reinforcement panel 1914 can include a height, $H_{RP}$. $H_{RP}$ can be measured from the upper edge of the reinforcement panel to the lower end of the reinforcement panel. The siding body 1902 of the siding panel 1900 may also include a height, $H_{SB}$. $H_{SB}$ can be measured from the upper edge 1906 of the siding body 1902 to the lower edge 1904 of the siding body 1902.

As indicated in FIG. 19, $H_{RP}$ may be less than $H_{SB}$. For example, $H_{RP}$ may be less than 95% $H_{SB}$. Further, $H_{RP}$ may be less than 94% $H_{SB}$, such as less than 94% $H_{SB}$, less than 93% $H_{SB}$, less than 92% $H_{SB}$, less than 91% $H_{SB}$, or less than 90% $H_{SB}$. In another aspect, $H_{RP}$ may be at least 80% $H_{SB}$, such as at least 81% $H_{SB}$, at least 82% $H_{SB}$, at least 83% $H_{SB}$, at least 84% $H_{SB}$, or at least 85% $H_{SB}$. It is to be understood that $H_{RP}$ may be within a range between, and including, any of the maximum or minimum values of H disclosed herein.

FIG. 19 further shows that a gap, G, may be formed between the reinforcement panel 1914 and the siding body 1902, e.g., the upper edge 1906 of the siding body 1902. In a particular aspect, G may be less than $H_{SB}$. For example, G may be less than 10% $H_{SB}$. Further, G may be less than 9.0% $H_{SB}$, such as less than 8.5% $H_{SB}$, less than 8.0% $H_{SB}$, less than 7.5% $H_{SB}$, less than 5.0% $H_{SB}$, or less than 2.5% $H_{SB}$. In another aspect, G may be at least 0.5% $H_{SB}$, such as at least 0.75% $H_{SB}$, at least 1.0% $H_{SB}$, at least 1.25% $H_{SB}$, at least 1.5% $H_{SB}$, at least 1.75% $H_{SB}$, or at least 2.0% $H_{SB}$. It is to be understood that G may be within a range between, and including, any of the maximum or minimum values of G disclosed herein.

FIG. 19 and FIG. 20 indicate that the siding panel 1900 can include a hanger section 1916 that can extend outwardly and upwardly from the upper edge 1906 of the siding body 1902. It is to be understood the outward direction is the direction away from the wall on which the siding panel 1900 may be installed. Further, the siding panel 1900 may be installed so that the reinforcement panel 1914 is immediately adjacent to, or closest to, a wall of the building or structure on which the siding panel 1900 is installed.

Specifically, the hanger section 1916 can include a lower lateral wall 1920 that can extend inwardly from the upper edge 1906 of the siding body 1902. The lower lateral wall 1920 can be substantially perpendicular to a longitudinal axis of the siding panel 1900. The lower lateral wall 1920 of the hanger section 1916 of the siding body 1902 can act as a guide or alignment feature for disposition of the reinforcement panel 1914 on the rear surface of the siding panel 1900.

An inner wall 1922 can extend in an upward direction from the lower lateral wall 1920. In a particular aspect, the lower inner wall 1922 can be substantially perpendicular to the lower lateral wall 1920. Further, as illustrated, an upper return leg 1924 can extend outwardly from the lower inner wall 1922. In particular, the upper return leg 1924 can be perpendicular to the lower inner wall 1922. Moreover, the upper return leg 1924 may be parallel to the lower lateral wall 1920. An inner curve 1926 can extend from the upper return leg 1924 and can curve in a downward direction, i.e., toward the lower edge 1904 of the siding body 1902. In addition, the inner curve 1926 can connect to an intermediate outer wall 1928.

As further shown in FIG. 20, a lower converging bend 1930 can extend from the intermediate outer wall 1928 and can turn nearly 180 degrees and an outer wall 1932 can extend in an upward direction from the lower converging bend 1930. An outer curve 1934 can connect an upper lateral extension 1936 to the outer wall 1932. The upper lateral extension 1936 may be substantially parallel to the upper return leg 1924 and the lower lateral wall 1920. Further, the upper lateral extension 1936 may extend inwardly from the outer wall 1932. An upper inner wall 1938 can extend in an upward direction from the upper lateral extension 1936. In particular, the upper inner wall 1938 may be substantially perpendicular to the upper lateral extension 1936. Further, the upper inner wall 1938 may be coplanar with the lower inner wall 1922 and when the siding panel 1900 is installed on an outer wall of a structure, the lower inner wall 1928 and the upper inner wall 1938 may contact an outer surface of the outer wall of the structure.

FIG. 20 further indicates that hanger section 1916 of the siding body 1902 of the siding panel 1900 may further include an upper converging bend 1940 that can turn approximately 180 degrees from the upper inner wall 1938 and connect to a tab 1942 that faces in a downward direction, i.e., toward the lower edge 1904 of the siding body 1902. The tab 1942 is substantially parallel to the upper inner wall 1938. The fold, i.e., roll-over, formed by the tab 1942 increases the rigidity of the siding body 1902, which can ease handling of the siding panel 1900 during installation. Moreover, the fold can increase windload performance of the siding panel 1900 after it is installed on an exterior wall of a structure.

Figure 22:
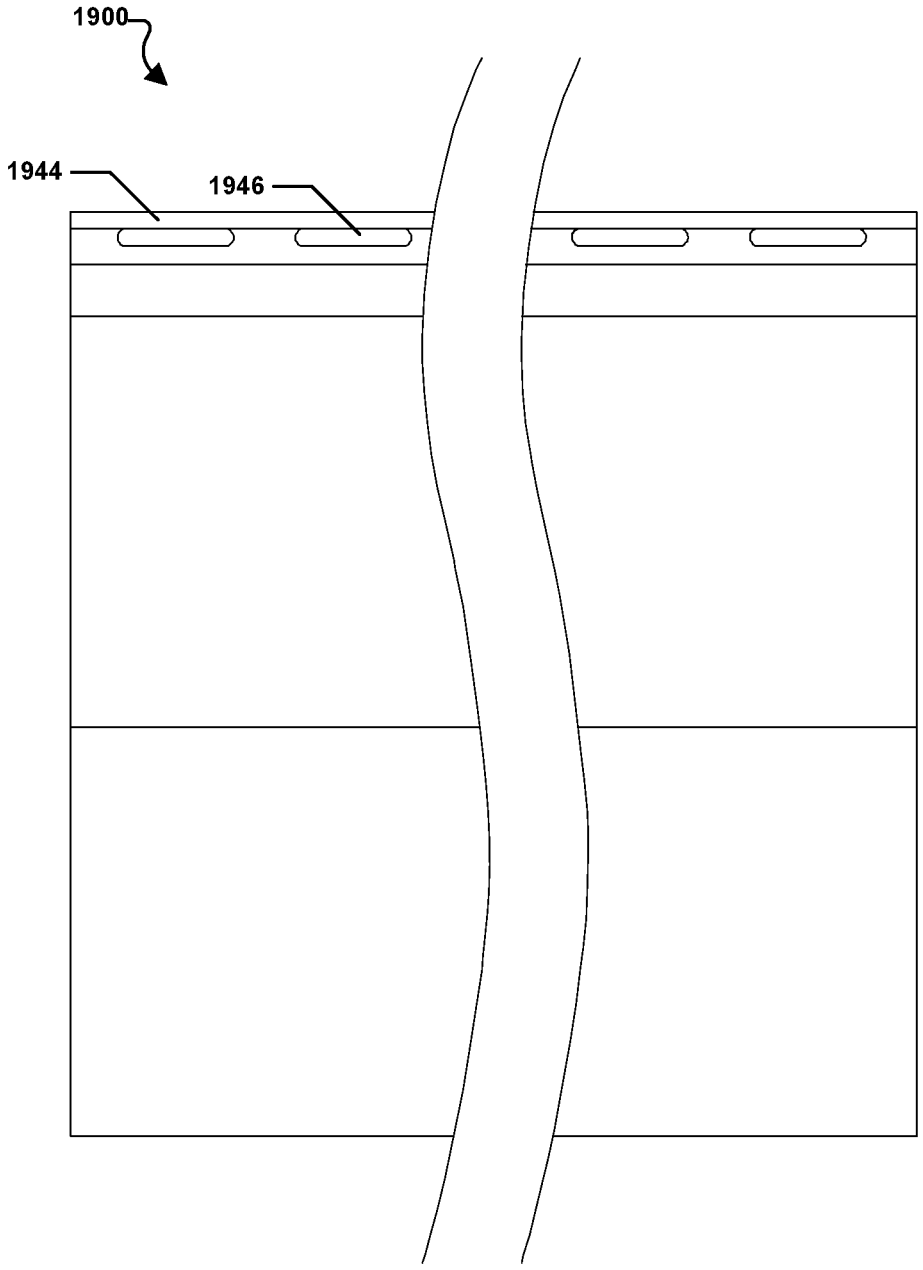
FIG. 22 includes an illustration of a front plan view of a siding panel in accordance with an embodiment.
Figure 23:
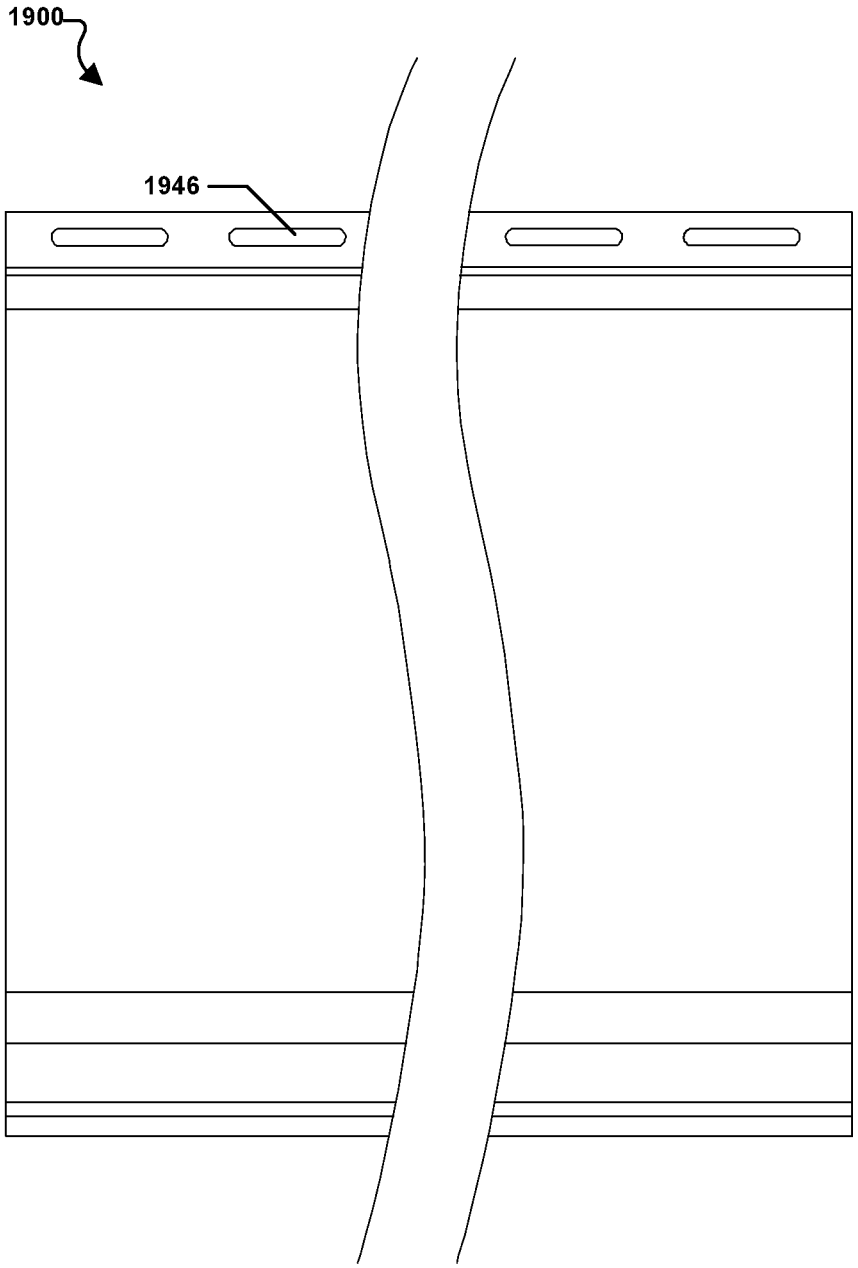
FIG. 23 includes an illustration of a rear plan view of a siding panel in accordance with an embodiment.

A fastener zone 1944, i.e., a nail hem, may be established below the fold formed by the tab 1942 and a portion of the upper inner wall 1938. FIG. 22 and FIG. 23 show that the fastener zone 1944 may be formed with one or more fastener slots 1946 through which the fasteners may be inserted. As illustrated, the fastener slots 1946 can extend through the tab 1942 and near the center of the upper inner wall 1938 adjacent to the tab 1942. In a particular aspect, the fastener slots 1946 can be equally spaced along the width of the siding panel 1900.

FIG. 20 further indicates the hanger section 1916 of the siding body 1902 of the siding panel 1900 may further include a recessed locking section 1948 that is formed within, or is bound by, the lower lateral wall 1920, the lower inner wall 1922, the upper return leg 1924, the inner curve 1926, and the intermediate outer wall 1928. In a particular aspect, the recessed locking section 1948 of the hanger section 1916 can be configured to receive a locking flange of an adjacent siding panel when the adjacent siding panel is properly installed over and engaged with the siding panel 1900 illustrated in FIG. 19. FIG. 20 further indicates that the hanger section 1916 of the siding body 1902 can further include an opening 1950 that may be established near the upper edge 1906 of the siding body 1902 between a flattened area 1952 just below the intermediate outer wall 1928 of the hanger section 1916 and the upper extension portion 1912. The opening 1950 may include a width, $W_O$, that can be defined by the closest linear distance between an inner face of intermediate outer wall 1928 of the hanger section 1916 and the outer face of the upper extension portion 1912. The width of the opening 1950 is designed to help the hanger section 1916 guide a lower locking section of an adjacent siding panel into the recessed locking section in an interference fit in order to lock two adjacent panels together when installed as described in greater detail below.

FIG. 20 also shows that the recessed locking section 1948 may further include a recessed area 1954. The recessed area 1954 is bound by the lower lateral wall 1920, the lower inner wall 1922 and the upper return leg 1924.

Referring now to FIG. 19 and FIG. 21, the siding body 1902 of the siding panel 1900 can further include a protrusion, i.e., a lower locking section 1960, formed at, or extending from, the lower edge 1904 of the siding body 1902. A portion of the lower locking section 1960 is recessed behind the lower extension portion 1908. In particular, as best viewed in FIG. 21, the lower locking section 1960 can include a lower return leg 1962 that can extend inwardly from the lower edge 1904 of the siding body 1902. The lower return leg 1962 may be substantially parallel to the central return leg 1910. Further, an upward extending lip 1964 can extend in a generally upward direction from the lower return leg 1962, i.e., toward the upper edge 1906 of the siding body 1902 of the siding panel 1900. In a particular aspect, the upward extending lip 1964 may be substantially parallel to a longitudinal axis of the siding panel 1900.

FIG. 21 further indicates that the lower locking section 1960 can also include a flange positioned at an end of the upwardly extending lip 1964. For example, the flange can include a locking flange 1966 that can extend generally in an inward direction from the upward extending lip 1964. In particular, the locking flange 1966 may include a lateral extension 1968 that is substantially perpendicular to a longitudinal axis of the siding panel 1900. Further, the locking flange 1966 can include a second upwardly extending lip 1970 that extends from, and is substantially perpendicular to, the lateral extension 1968.

The locking flange 1966 of the lower locking section 1960 can be inserted into an engage the hanger section of an adjacent siding panel. Specifically, the locking flange 1966 can be inserted into a recessed locking section of an adjacent siding panel. FIG. 21 further indicates that the locking flange 1966 can include an overall width, $W_L$, that can be defined as the largest linear distance between an outer face of the upward extending lip 1964 at the transition to the lateral extension 1968 and an innermost surface of the second upwardly extending lip 1970 of the locking flange 1966.

In a particular aspect, $W_L$ may be larger than $W_O$. For example, $W_L$ can be at least $1.05\times W_O$. Further, $W_L$ can be at least $1.1\times W_O$, such as at least $1.25\times W_O$, at least $1.5\times W_O$, at least $1.75\times W_O$, or at least $2.0\times W_O$. In another aspect, $W_L$ may be no greater than $3.0\times W_O$. Further, $W_L$ may be no greater than $2.75\times W_O$, such as no greater than $2.5\times W_O$, or no greater than $2.25\times W_O$. It is to be understood that $W_L$ may be within a range between, and including, any of the maximum or minimum values of $W_L$ disclosed herein. Since $W_L$ is greater than $W_O$, when two adjacent panels are installed on an exterior wall of a structure as described below, this configuration can allow the lower locking section of one panel to be snapped into place within the hanger section of an adjacent panel and interlock the two panels.

In a particular aspect, the siding body 1902 can be manufactured from a material that includes a composite material. The composite material may include a polymeric material. Further, the polymeric material can include polyvinyl chloride. In a particular aspect, the reinforcement panel 1914 can include a foam layer affixed to the rear surface of the siding body 1902 of the siding panel 1900. The foam layer can be affixed to the rear surface of the siding body 1902 using an adhesive. Further, the foam layer can include a rigid foam insulating material. For example, the reinforcement panel 1914, or foam layer, can include a polyisocyanurate foam insulating material. Further, the polyisocyanurate foam insulating material can include a closed-cell polyisocyanurate foam insulating material. In another aspect, the reinforcement panel 1914, or foam layer, can include a polystyrene foam insulating material. For example, the polystyrene foam insulating material can include an extruded polystyrene foam insulating material. In another aspect, the polystyrene foam insulating material can include an expanded polystyrene foam insulating material.

Siding Panel Assemblies

FIG. 24 through 34 illustrate various additional siding panel assemblies that include one or more features that may be incorporated into the various siding panel designs described herein.

Figure 24:
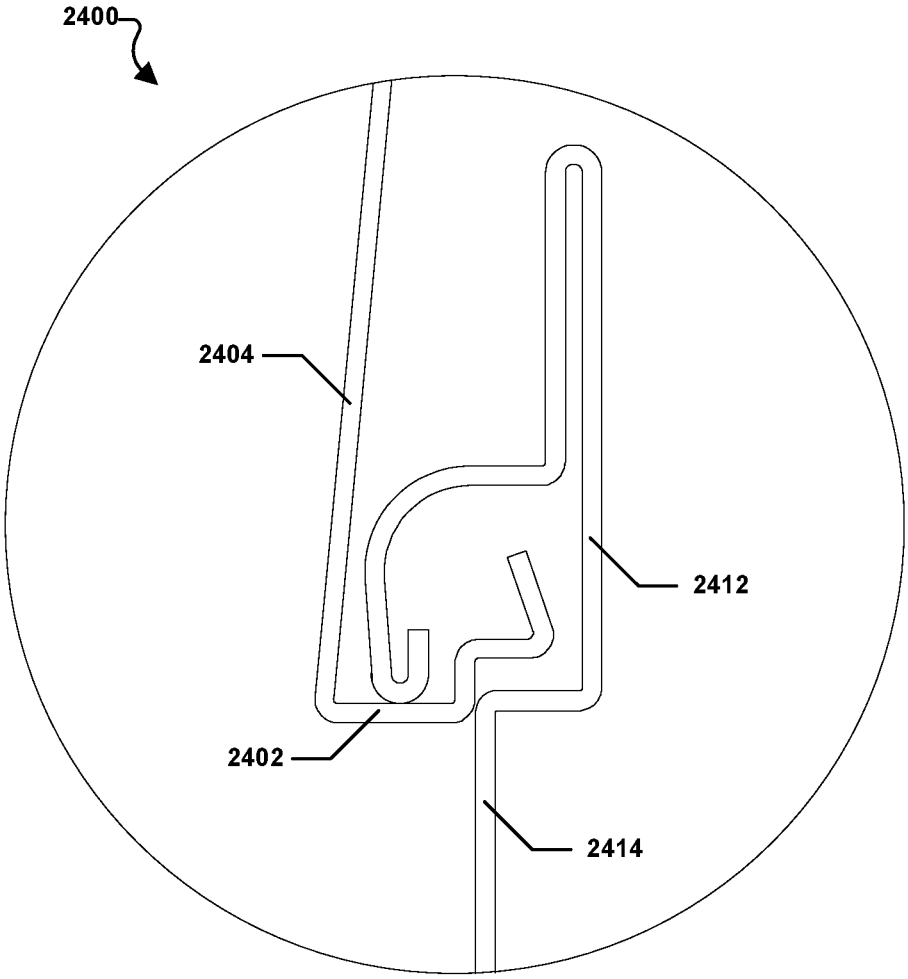
FIG. 24 includes an illustration of a detail view of two adjacent house siding panels in accordance with an embodiment.

FIG. 24 includes a detail view of a siding panel assembly 2400 that includes a locking section 2402 of a second siding panel 2404 engaged with a hanger section 2412 of a first siding panel 2414.

Figure 25:
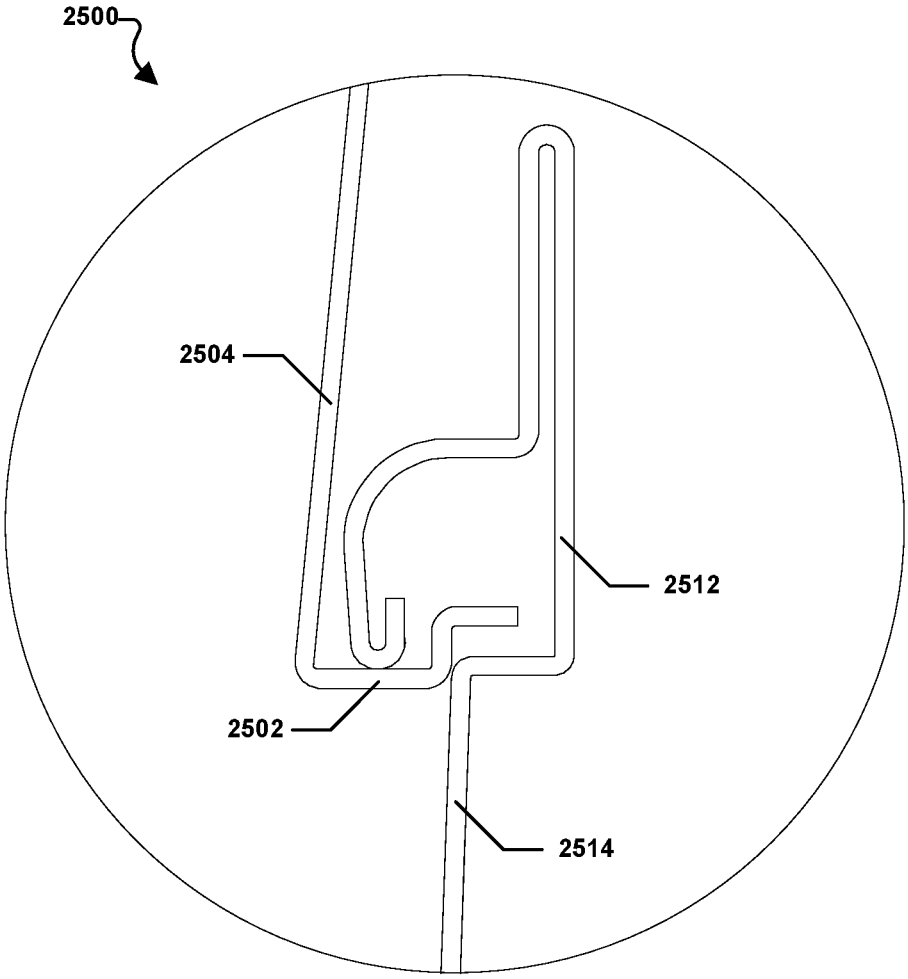
FIG. 25 includes an illustration of a detail view of two adjacent house siding panels in accordance with an embodiment.

FIG. 25 includes a detail view of a siding panel assembly 2500 that includes a locking section 2502 of a second siding panel 2504 engaged with a hanger section 2512 of a first siding panel 2514.

Figure 26:
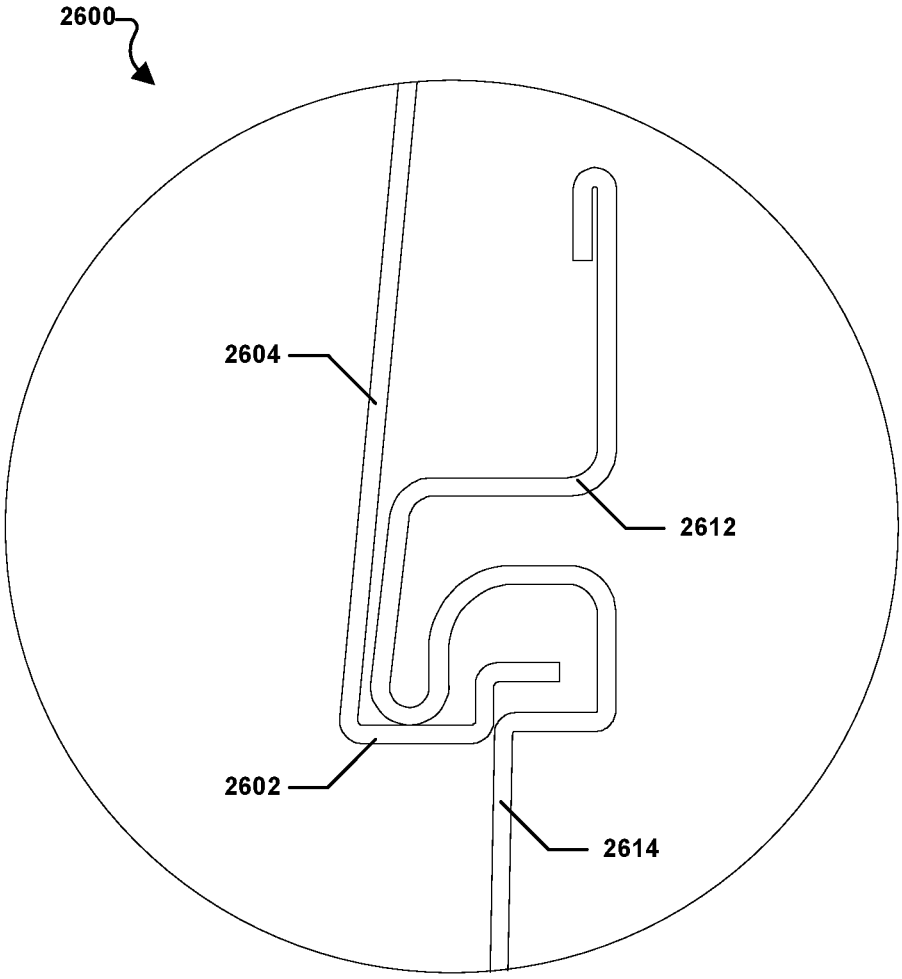
FIG. 26 includes an illustration of a detail view of two adjacent house siding panels in accordance with an embodiment.

FIG. 26 includes a detail view of a siding panel assembly 2600 that includes a locking section 2602 of a second siding panel 2604 engaged with a hanger section 2612 of a first siding panel 2614.

Figure 27:
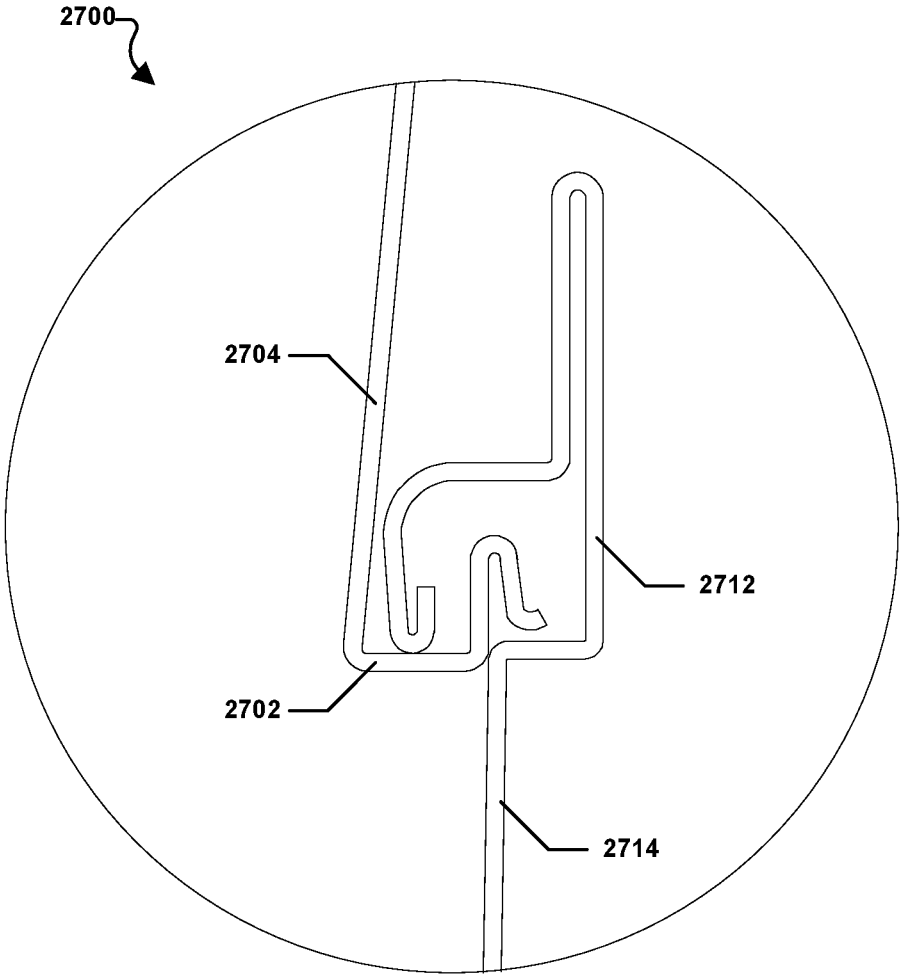
FIG. 27 includes an illustration of a detail view of two adjacent house siding panels in accordance with an embodiment.

FIG. 27 includes a detail view of a siding panel assembly 2700 that includes a locking section 2702 of a second siding panel 2704 engaged with a hanger section 2712 of a first siding panel 2714.

Figure 28:
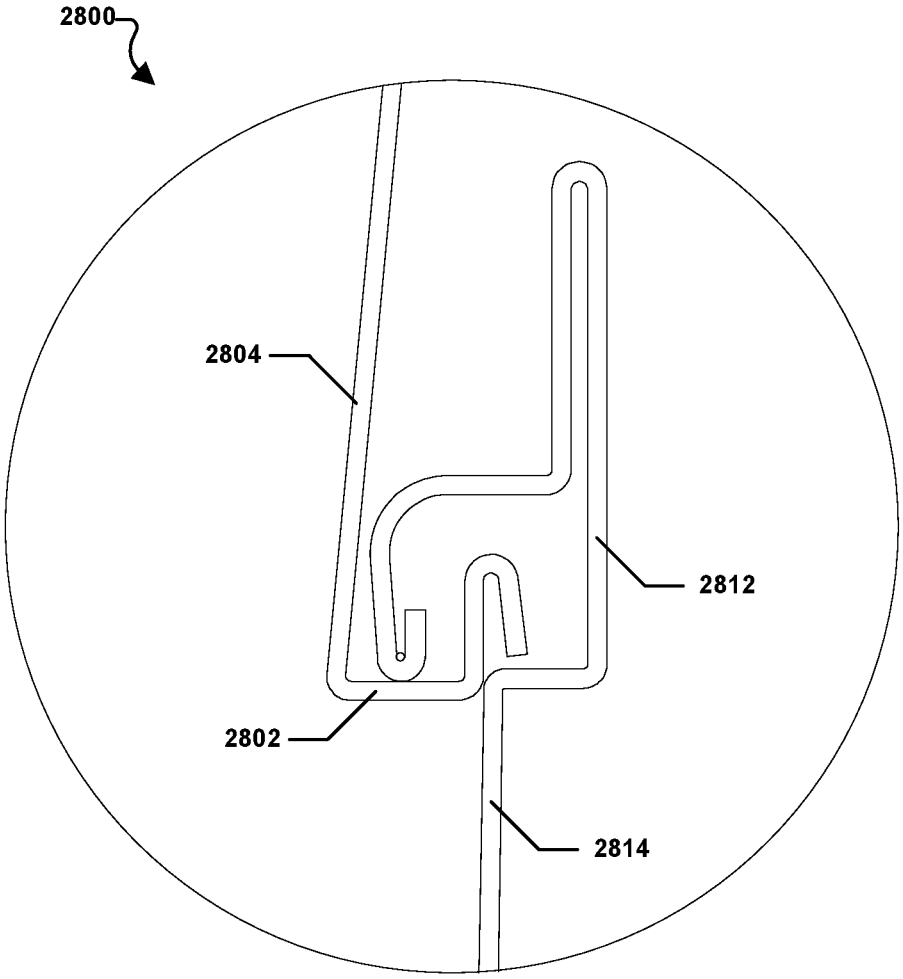
FIG. 28 includes an illustration of a detail view of two adjacent house siding panels in accordance with an embodiment.

FIG. 28 includes a detail view of a siding panel assembly 2800 that includes a locking section 2802 of a second siding panel 2804 engaged with a hanger section 2812 of a first siding panel 2814.

Figure 29:
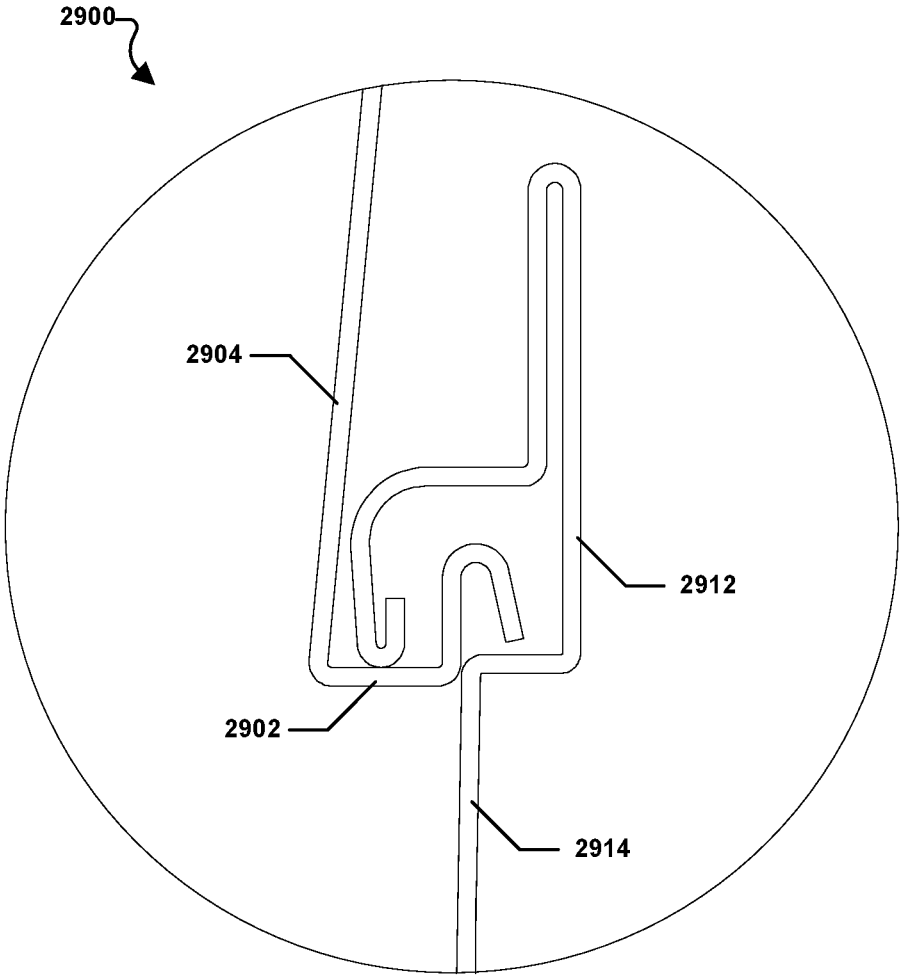
FIG. 29 includes an illustration of a detail view of two adjacent house siding panels in accordance with an embodiment.

FIG. 29 includes a detail view of a siding panel assembly 2900 that includes a locking section 2902 of a second siding panel 2904 engaged with a hanger section 2912 of a first siding panel 2914.

Figure 30:
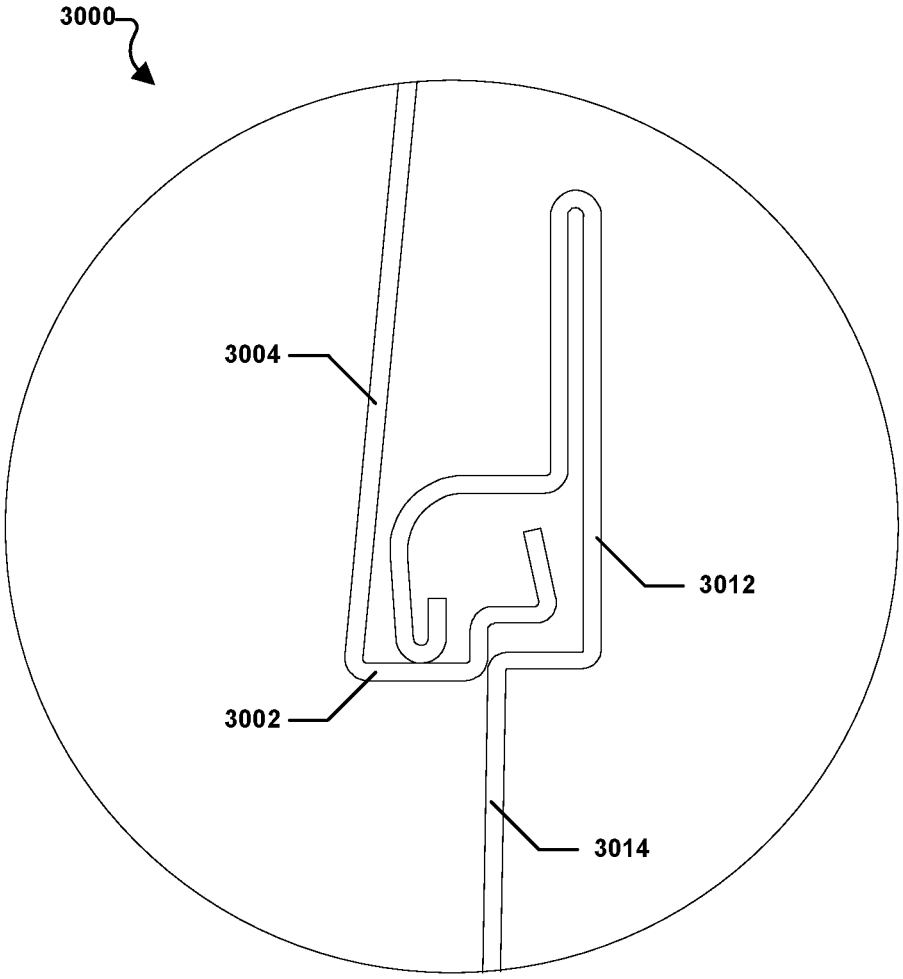
FIG. 30 includes an illustration of a detail view of two adjacent house siding panels in accordance with an embodiment.

FIG. 30 includes a detail view of a siding panel assembly 3000 that includes a locking section 3002 of a second siding panel 3004 engaged with a hanger section 3012 of a first siding panel 3014.

Figure 31:
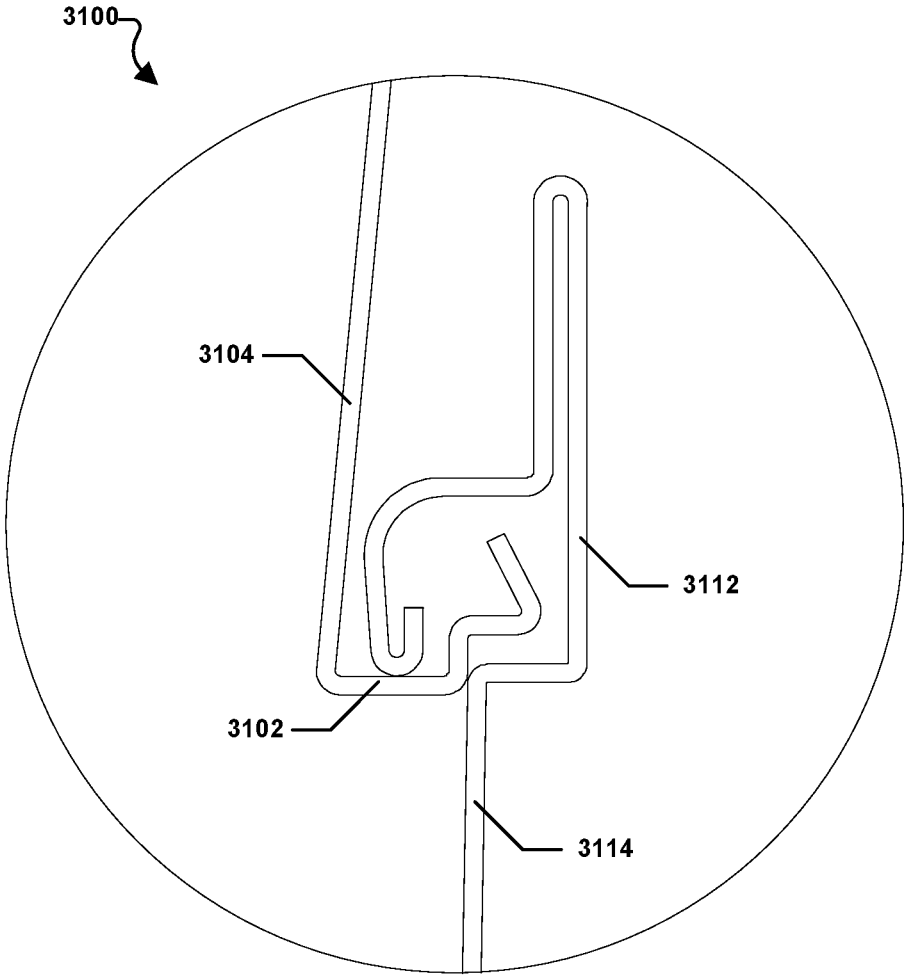
FIG. 31 includes an illustration of a detail view of two adjacent house siding panels in accordance with an embodiment.

FIG. 31 includes a detail view of a siding panel assembly 3100 that includes a locking section 3102 of a second siding panel 3104 engaged with a hanger section 3112 of a first siding panel 3114.

Figure 32:
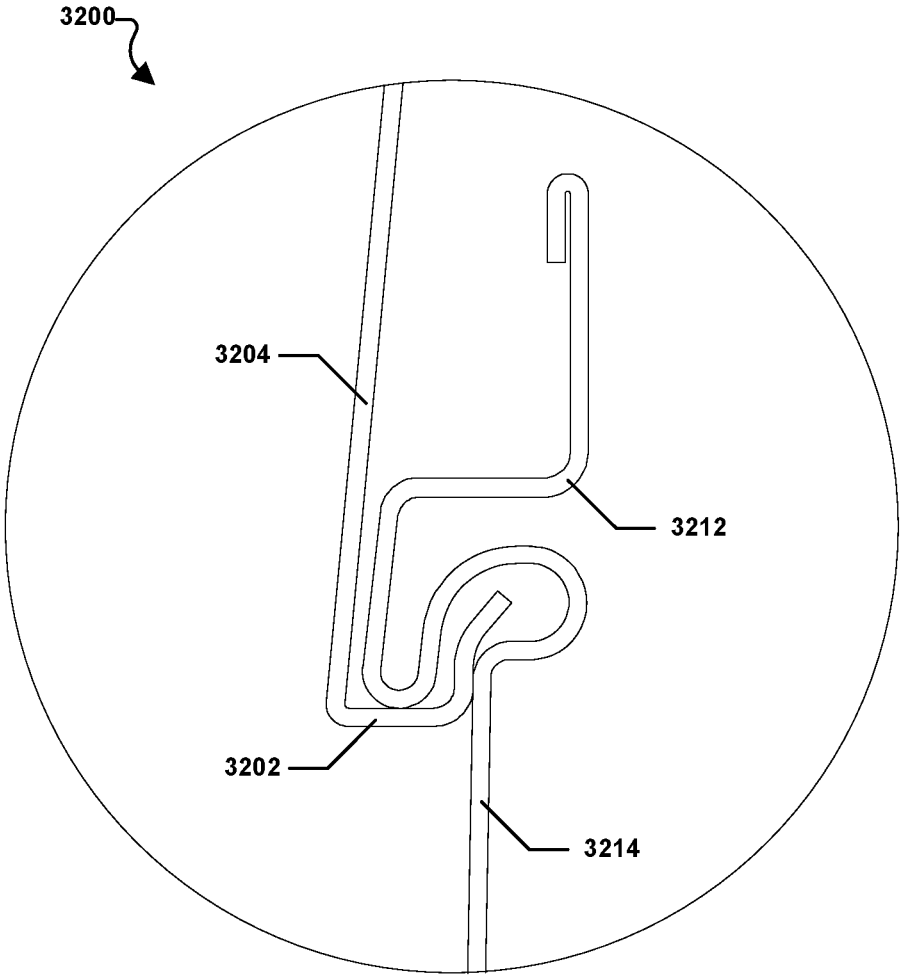
FIG. 32 includes an illustration of a detail view of two adjacent house siding panels in accordance with an embodiment.

FIG. 32 includes a detail view of a siding panel assembly 3200 that includes a locking section 3202 of a second siding panel 3204 engaged with a hanger section 3212 of a first siding panel 3214.

It can be appreciated that while each design disclosed herein can include two extension portions to simulate overlapping wood siding, these designs can include a single extension portion between an upper edge and a lower edge. Further, while the designs disclosed herein are shown installed horizontally on a wall, the designs may be configured to simulate T1-11 siding and in such a case, the designs can be installed vertically.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

Embodiment 1. A siding interlock panel comprising: a siding body including a front surface, a rear surface, a top edge, and a bottom edge; a retaining loop extending outwardly from the siding body, the retaining loop comprising: an outer curve, an inner curve, the inner curve terminating at a flat base defining the bottom of a recess within the retaining loop, and a retaining wall extending outwardly from the siding body; a stretch extending from the retaining loop, the stretch and retaining loop defining a gap; an engagement portion comprising: a first outer bend, a second outer bend, a first extension positioned between the first outer bend and the second outer bend and perpendicular to the retaining loop, a second extension projecting toward the top edge, and an ending loop including a leading bend, a cantilever leg, a lower bend, and a tip; wherein the ending loop is configured to penetrate the gap via a force applied by the retaining loop so that the tip projects toward the second extension, reducing the thickness of the ending loop to less than the thickness of the gap; and wherein the ending loop is configured to avoid contact with the retaining loop when positioned within the retaining loop.

Embodiment 2. The panel of embodiment 1, further comprising at least one ridge extending laterally across a width of the siding body.

Embodiment 3. The panel of embodiment 1, wherein the siding body comprises a composite material.

Embodiment 4. The panel of embodiment 3, wherein the composite material comprises a polymeric material.

Embodiment 5. The panel of embodiment 4, wherein the polymeric material comprises polyvinyl chloride.

Embodiment 6. The panel of embodiment 1, wherein the siding body comprises a metal.

Embodiment 7. The panel of embodiment 1, further comprising an attachment panel positioned at the top edge.

Embodiment 8. The panel of embodiment 7, wherein the attachment panel is folded on itself.

Embodiment 9. The panel of embodiment 1, wherein the siding body is configured to be affixed to a vertical wall of a structure.

Embodiment 10. The panel of embodiment 1, wherein the retaining loop is positioned adjacent the top edge.

Embodiment 11. The panel of embodiment 1, wherein the outer curve and the inner curve converge at a hairpin bend.

Embodiment 12. The panel of embodiment 11, wherein the hairpin bend extends toward the bottom edge.

Embodiment 13. The panel of embodiment 11, wherein the retaining wall is positioned closer to the top edge than the hairpin bend.

Embodiment 14. The panel of embodiment 1, wherein the outer curve projects at an outward angle in relation to the siding body.

Embodiment 15. The panel of embodiment 1, wherein the flat base is aligned with the top edge.

Embodiment 16. The panel of embodiment 1, wherein the stretch extends from the retaining wall to the first outer bend.

Embodiment 17. The panel of embodiment 1, wherein the stretch projects at an outward angle in relation to the siding body.

Embodiment 18. The panel of embodiment 1, wherein the stretch is substantially parallel to at least a portion of the outer curve when the panel is engaged with a second panel.

Embodiment 19. The panel of embodiment 1, wherein the second outer bend comprises an angle larger than that of the first outer bend.

Embodiment 20. The panel of embodiment 1, wherein the first extension and the hairpin bend contact one another when the engagement portion is engaged with the retaining loop.

Embodiment 21. The panel of embodiment 1, wherein the second extension and the stretch contact one another when the engagement portion is engaged with the retaining loop.

Embodiment 22. The panel of embodiment 1, wherein the first extension provides an upward force to the retaining loop of a second panel when the panel is affixed to a vertical wall of a structure.

Embodiment 23. The panel of embodiment 1, wherein contact between the first extension and the hairpin bend prevent contact between the engagement portion and the retaining loop when the engagement portion is engaged with the retaining loop.

Embodiment 24. The panel of embodiment 1, wherein the tip projects outward in relation to the siding body.

Embodiment 25. The panel of embodiment 1, wherein the siding body further comprises a foam layer affixed to the rear surface.

Embodiment 26. The panel of embodiment 25, wherein the foam layer is affixed to the rear surface via an adhesive.

Embodiment 27. A siding panel assembly comprises a first siding panel having a siding body including upper and lower edges, and a protrusion adjacent to the lower edge, the protrusion extending generally upwardly from the lower edge of the siding body. The siding panel assembly also includes a second siding panel having a siding body including upper and lower edges, and a hanger section adjacent the upper edge, the hanger section defining a recessed locking section for receiving the protrusion from the first siding panel. The protrusion comprises a lateral extension and the hanger section comprising a lateral wall, the lateral wall and the lateral extension overlaying each other in assembled form.

Embodiment 28. The siding panel assembly of embodiment 27, wherein the first siding panel further includes a hanger section adjacent to the upper edge and the second siding panel further includes a protrusion adjacent to the lower edge.

Embodiment 29. The siding panel assembly of embodiment 27, wherein the first siding panel and the second siding panel include the same cross section.

Embodiment 30. The siding panel assembly of embodiment 27, wherein the lateral wall and the lateral extension overlie each other in assembled form such that the first and second siding panels have an interference fit.

Embodiment 31. The siding panel assembly of embodiment 27, wherein the recessed locking section includes an opening through which the protrusion is fitted in assembled form.

Embodiment 32. The siding panel assembly of embodiment 31, wherein the opening is defined by the hanger section and the siding body of the second siding panel.

Embodiment 33. The siding panel assembly of embodiment 27, wherein the recessed locking section includes a recess partially defined by the lateral wall.

Embodiment 34. The siding panel assembly of embodiment 27, wherein the recessed locking section includes an inner wall that extends from the lateral wall and partially bounds the recess.

Embodiment 35. The siding panel assembly of embodiment 27, wherein the protrusion includes a tip comprising a loop, the loop having a return portion forming the lateral extension.

Embodiment 36. The siding panel assembly of embodiment 27, wherein the protrusion includes a return leg adapted to penetrate into the recessed locking section, and a flange extending from the return leg and defining the lateral extension.

Embodiment 37. The siding pane assembly of embodiment 36, wherein the protrusion comprises a lip upwardly extending from the flange.

Embodiment 38. The siding panel assembly of embodiment 27, wherein the lateral wall and the lateral extension are generally parallel to each other in assembled form.

Embodiment 39. The siding panel assembly of embodiment 34, wherein the hanger section comprises an outer curve and an inner curve, the inner curve terminating at the inner wall.

Embodiment 40. The siding panel assembly of embodiment 39, wherein the outer curve and the inner curve converge at a converging bend.

Embodiment 41. The siding panel assembly of embodiment 39, wherein the outer curve projects at an outward angle in relation to the siding body.

Embodiment 42. The siding panel assembly of embodiment 39, wherein the inner wall of the inner curve is aligned with the upper edge of the second siding panel.

Embodiment 43. The siding panel assembly of embodiment 40, wherein the converging bend extends toward the lower edge of the second siding panel.

Embodiment 44. The siding panel assembly of embodiment 40, wherein the lateral wall is positioned closer to the upper edge than the converging bend when the lateral wall and the lateral extension overlie each other in assembled form.

Embodiment 45. The siding panel assembly of embodiment 40, wherein the lower edge of the first siding panel and the converging bend contact one another when the lateral wall and the lateral extension overlie each other in assembled form.

Embodiment 46. The siding panel assembly of embodiment 27, wherein the siding bodies of the first siding panel and the second siding panel comprise a composite material.

Embodiment 47. The siding panel assembly of embodiment 46, wherein the composite material comprises a polymeric material.

Embodiment 48. The siding panel assembly of embodiment 47, wherein the polymeric material comprises polyvinyl chloride.

Embodiment 49. The siding panel assembly of embodiment 27, wherein the siding bodies of the first siding panel and the second siding panel comprise a metal.

Embodiment 50. The siding panel assembly of embodiment 27, further comprising a fastener zone positioned at the upper edge of at least one of the first siding panel and the second siding panel.

Embodiment 51. The siding panel assembly of embodiment 50, wherein the fastener zone is folded on itself.

Embodiment 52. The siding panel assembly of embodiment 27, wherein the siding bodies of the first siding panel and the second siding panels are configured to be affixed to a vertical wall of a structure.

Embodiment 53. The siding panel assembly of embodiment 27, wherein the hanger section is positioned adjacent the upper edge of the second siding panel.

Embodiment 54. The siding panel assembly of embodiment 27, further comprising an extension portion extending from the hanger section to the return leg.

Embodiment 55. The siding panel assembly of embodiment 54, wherein the extension portion projects at an outward angle in relation to the siding body of the second siding panel.

Embodiment 56. The siding panel assembly of embodiment 54, wherein the protrusion and the extension portion contact one another when the lateral wall and the lateral extension overlie each other in assembled form.

Embodiment 57. The siding panel assembly of embodiment 27, wherein the lower edge of the first siding panel provides an upward force to the hanger section when the first siding panel is affixed to a vertical wall of a structure.

Embodiment 58. The siding panel assembly of embodiment 27, wherein at least one of the siding bodies of the first siding panel and the second siding panel further comprises a foam layer affixed to a rear surface of the at least one of the siding bodies of the first siding panel and the second siding panel.

Embodiment 59. The siding panel assembly of embodiment 58, wherein the foam layer is affixed to the rear surface via an adhesive.

Embodiment 60. A siding panel comprising a siding body including upper and lower edges, a protrusion adjacent to the lower edge, the protrusion extending generally upwardly from the lower edge of the siding body, wherein the protrusion comprises a lateral extension, a hanger section adjacent to the upper edge, the hanger section defining a recessed locking section for receiving a protrusion from an adjacent siding panel in an interference fit, wherein the hanger section comprises a lateral wall.

Embodiment 61. The siding panel of embodiment 60, wherein the recessed locking section includes an opening through which the protrusion the adjacent siding panel is fitted in assembled form.

Embodiment 62. The siding panel of embodiment 61, wherein the opening is defined by the hanger section and the siding body.

Embodiment 63. The siding panel of embodiment 60, wherein the recessed locking section includes a recess partially defined by the lateral wall.

Embodiment 64. The siding panel of embodiment 63, wherein the recessed locking section includes an inner wall that extends from the lateral wall and partially bounds the recess.

Embodiment 65. The siding panel of embodiment 60, wherein the protrusion includes a return leg adapted to penetrate into a recessed locking section of an adjacent siding panel, and a flange extending from the return leg and defining the lateral extension.

Embodiment 66. The siding panel of embodiment 65, wherein the protrusion comprises a lip upwardly extending from the flange.

Embodiment 67. The siding panel of embodiment 60, wherein the hanger section comprises an outer curve and an inner curve, the inner curve terminating at the inner wall.

Embodiment 68. The siding panel of embodiment 67, wherein the outer curve and the inner curve converge at a converging bend.

Embodiment 69. The siding panel of embodiment 68, wherein the outer curve projects at an outward angle in relation to the siding body.

Embodiment 70. The siding panel of embodiment 60, wherein the siding body comprises a composite material.

Embodiment 71. The siding panel of embodiment 70, wherein the composite material comprises a polymeric material.

Embodiment 72. The siding panel of embodiment 71, wherein the polymeric material comprises polyvinyl chloride.

Embodiment 73. The siding panel of embodiment 60, further comprising a fastener zone positioned at the upper edge of the siding panel.

Embodiment 74. The siding panel of embodiment 73, wherein the fastener zone is folded on itself.

Embodiment 75. The siding panel of embodiment 60, further comprising a foam layer affixed to a rear surface of the siding body of the siding panel.

Embodiment 76. The siding panel of embodiment 75, wherein the siding body includes a height, HSB, from the upper edge of the siding body to the lower edge of the siding body and the foam layer establishes a gap, G, between the foam layer and the upper edge of the siding body and G is less than 10% HSB.

Embodiment 77. The siding panel of embodiment 76, wherein G is less than 9.0% HSB, such as less than 8.5% HSB, less than 8.0% HSB, less than 7.5% HSB, less than 5.0% HSB, or less than 2.5% HSB.

Embodiment 78. The siding panel of embodiment 77, wherein G is at least 0.5% HSB, such as at least 0.75% HSB, at least 1.0% HSB, at least 1.25% HSB, at least 1.5% HSB, at least 1.75% HSB, or at least 2.0% HSB.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive. Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A siding panel, comprising:

a siding body having a front surface, a rear surface, an upper edge, and a lower edge;

a hanger section extending from the upper edge; and a lower locking section extending from the lower edge, the hanger section comprising:

a lower lateral wall extending inwardly from the upper edge of the siding body;

a lower inner wall extending in an upward direction from the lower lateral wall;

an upper return leg extending outwardly from the lower inner wall;

an inner curve connecting the upper return leg to an intermediate outer wall; and a lower converging bend extending from the intermediate outer wall to an outer wall extending in an upward direction from the lower converging bend; and the lower locking section comprising:

a lower return leg;

an upwardly extending lip; and a locking flange comprising an inwardly extending lateral extension extending from the upwardly extending lip and a second upwardly extending lip extending substantially perpendicularly from the inwardly extending lateral extension, wherein the locking flange is configured to be inserted into a hanger section of an adjacent siding panel, and wherein the locking flange is configured to prevent the second upwardly extending lip from contacting the hanger section of the adjacent siding panel.

2. The siding panel of claim 1, wherein the lower return leg extends inwardly from the lower edge.

3. The siding panel of claim 1, wherein the inwardly extending lateral extension is substantially perpendicular to a longitudinal axis of the siding panel.

4. The siding panel of claim 1, wherein the locking flange and the hanger section comprises an interference fit.

5. The siding panel of claim 4, wherein the locking flange comprises a width, $W_L$, wherein an opening of the hanger section comprises a width, $W_O$, and wherein $W_L$ is larger than $W_O$.

6. The siding panel of claim 1, wherein the siding panel comprises an upper extension portion that extends from the upper edge to a central return leg.

7. The siding panel of claim 6, wherein the siding panel comprises a lower extension portion that extends from the central return leg to the lower edge.

8. The siding panel of claim 7, wherein the upper extension portion and the lower extension portion are configured to visually simulate single courses of overlapping siding, wherein the overlap is simulated by the central return leg.

9. The siding panel of claim 1, further comprising a reinforcement panel disposed on the rear surface of the siding body.

10. A siding panel assembly, comprising:

a first siding panel having a siding body having a front surface, a rear surface, an upper edge, and a lower edge, wherein the first siding panel comprises a hanger section extending from the upper edge, wherein the hanging section comprises:

a lower lateral wall extending inwardly from the upper edge of the siding body;

a lower inner wall extending in an upward direction from the lower lateral wall;

an upper return leg extending outwardly from the lower inner wall;

an inner curve connecting the upper return leg to an intermediate outer wall; and a lower converging bend extending from the intermediate outer wall to an outer wall extending in an upward direction from the lower converging bend; and a second siding panel having a siding body having a front surface, a rear surface, an upper edge, and a lower edge, wherein the second siding panel comprises a lower locking section extending from the lower edge, wherein the lower locking section comprises:

a lower return leg;

an upwardly extending lip; and a locking flange comprising an inwardly extending lateral extension extending from the upwardly extending lip and a second upwardly extending lip extending substantially perpendicularly from the inwardly extending lateral extension;

wherein the lower locking section of the second siding panel is configured to engage the hanger section of the first siding panel, wherein the locking flange of the lower locking section of the second siding panel is disposed within a recessed locking section of the hanger section of the first siding panel, and wherein the locking flange of the lower locking section of the second siding panel is prevented from contacting the recessed locking section of the hanger section of the first siding panel.

11. The siding panel assembly of claim 10, wherein the locking flange of the lower locking section of the second siding panel is prevented from contacting the recessed locking section of the hanger section of the first siding panel by contact between a bend portion of the hanger section of the first siding panel and the lower return leg of the lower locking section of second siding panel.

12. The siding panel assembly of claim 10, wherein the locking flange of the lower locking section of the second panel and the hanger section of the first siding panel comprise an interference fit, wherein the locking flange comprises a width, $W_L$, wherein an opening of the hanger section comprises a width, $W_O$, and wherein $W_L$ is larger than $W_O$.

13. The siding panel assembly of claim 10, further comprising a reinforcement panel disposed on the rear surface of at least one of the siding bodies of the first siding panel and the second siding panel.

14. The siding panel assembly of claim 10, wherein the second siding panel comprises a hanger section extending from the upper edge of the second siding panel.

15. The siding panel assembly of claim 14, further comprising:

a third siding panel having a siding body having a front surface, a rear surface, an upper edge, and a lower edge, wherein the third siding panel comprises a lower locking section extending from the lower edge, wherein the lower locking section comprises:

a lower return leg;

an upwardly extending lip; and a locking flange comprising an inwardly extending lateral extension extending from the upwardly extending lip and a second upwardly extending lip extending substantially perpendicularly from the inwardly extending lateral extension;

wherein the lower locking section of the third siding panel is configured to engage the hanger section of the second siding panel.

* * * * *